US009109426B2

(12) United States Patent
Khulusi

(10) Patent No.: US 9,109,426 B2
(45) Date of Patent: Aug. 18, 2015

(54) APPARATUS AND METHOD FOR PLUGGING BLOWOUTS

(71) Applicant: Basimah Khulusi, Kansas City, MO (US)

(72) Inventor: Basimah Khulusi, Kansas City, MO (US)

( * ) Notice: Subject to any disclaimer, the term of this patent is extended or adjusted under 35 U.S.C. 154(b) by 202 days.

(21) Appl. No.: 13/831,335

(22) Filed: Mar. 14, 2013

(65) Prior Publication Data

US 2013/0299201 A1 Nov. 14, 2013

Related U.S. Application Data

(63) Continuation-in-part of application No. 12/862,503, filed on Aug. 24, 2010, now abandoned.

(60) Provisional application No. 61/360,851, filed on Jul. 1, 2010.

(51) Int. Cl.

| | |
|---|---|
| ***E21B 33/126*** | (2006.01) |
| ***E21B 33/06*** | (2006.01) |
| ***E21B 33/12*** | (2006.01) |
| ***E21B 43/10*** | (2006.01) |

(52) U.S. Cl.

CPC ..... *E21B 33/126* (2013.01); *E21B 33/06* (2013.01); *E21B 33/1208* (2013.01); *E21B 43/10* (2013.01)

(58) Field of Classification Search

CPC . E21B 33/127; E21B 33/126; E21B 43/0122; E21B 33/06; E21B 33/1208; E21B 43/10

USPC ..... 166/285, 373, 381, 382, 386, 387, 73, 166/83.1, 117.6, 179, 118, 132, 185, 202, 166/206, 213, 316, 320, 332.1, 363, 364

See application file for complete search history.

(56) References Cited

U.S. PATENT DOCUMENTS

| | | | | | |
|---|---|---|---|---|---|
| 46,860 | A | * | 3/1865 | Moulton | 277/335 |
| 1,549,168 | A | * | 8/1925 | Townsend | 277/331 |
| 1,676,785 | A | | 7/1928 | Lewis | |
| 2,253,224 | A | | 8/1941 | Bleakley | |
| 2,344,120 | A | * | 3/1944 | Baker | 166/289 |
| 2,646,845 | A | | 7/1953 | Schillinger | |
| 2,800,185 | A | | 7/1957 | Teplitz | |
| 2,922,478 | A | * | 1/1960 | Maly | 166/154 |
| 2,955,625 | A | | 5/1976 | Hughes et al. | |

(Continued)

OTHER PUBLICATIONS

Levin, "Freeze It, Crimp It, Nuke It" Slate Magazine, http://www.slate.com/id/2254529, May 26, 2010.

(Continued)

*Primary Examiner* — James G Sayre
(74) *Attorney, Agent, or Firm* — Lathrop & Gage LLP

(57) ABSTRACT

A system for plugging an oil well comprises a hollow drill string. A connecting device having an upper surface, a side surface, and a lower surface having a recess is loosely situated around the drill string. A first skirt has a plurality of first rods that are each pivotally connected to the upper surface. A second skirt has a plurality of second rods that are each pivotally connected to the lower surface. A first fastening ring is configured to selectively allow the first skirt to transition from a closed position to an open position. A second fastening ring is configured to selectively allow the second skirt to transition from a closed position to an open position. A stop having a beveled edge is secured to the drill string. The recess is configured to allow the connecting device to mate with the stop's beveled edge.

21 Claims, 25 Drawing Sheets

(56) References Cited

U.S. PATENT DOCUMENTS

| | | | | |
|---|---|---|---|---|
| 4,469,174 | A | 9/1984 | Freeman | |
| 4,790,936 | A * | 12/1988 | Renfrow | 210/242.3 |
| 6,343,650 | B1 | 2/2002 | Ringgenberg | |
| 6,454,001 | B1 * | 9/2002 | Thompson et al. | 166/250.14 |
| 6,951,262 | B2 | 10/2005 | West | |
| 2003/0037932 | A1 * | 2/2003 | Guillory et al. | 166/387 |
| 2013/0168090 | A1 * | 7/2013 | Themig et al. | 166/285 |
| 2014/0356068 | A1 * | 12/2014 | Andritsos et al. | 405/60 |

OTHER PUBLICATIONS

Stop the Gulf Oil Spill, How Would You Stop the Leak, UserVoice 2010, http://www.stopthegulfspill.com/pages/50547-how-would-you-stop-the-leak-?filter=top&page=7.

Office Action in related U.S. Appl. No. 12/862,503 dated Sep. 25, 2012.

* cited by examiner

APPARATUS AND METHOD FOR PLUGGING BLOWOUTS

CROSS-REFERENCE TO RELATED APPLICATIONS

This application is a continuation-in-part of U.S. patent application Ser. No. 12/862,503 filed Aug. 24, 2010, which claims priority to U.S. Provisional Patent Application Ser. No. 61/360,851 filed Jul. 1, 2010. The disclosure of each is incorporated herein by reference in its entirety.

FIELD OF THE INVENTION

The disclosed subject matter is directed to a technology for eliminating the flow of oil and gas from a blowout, and for production of oil from an oil well.

BACKGROUND OF THE INVENTION

Drilling a well for the production of oil is an involved process, and different types of drill strings may be used to effectuate the drilling. A drill string is a column or string of drill pipe, and the term drill string is loosely applied to the assembled collection of the drill pipe, drill collars, and a drill bit. Drill collars are thick walled pipes that, by virtue of their heavy weight, aid the drill bit in the drilling process. Drilling fluid, which is also known as "mud" by those versed in the art and which consists of carefully tailored solids and chemicals, is pumped down the inside of the hollow drill string. The mud cools the drill bit as it drills, stabilizes the rock in the well walls, and lifts the rock cuttings generated by the drilling up to the surface. The mud can then be recycled and re-used. Instead of a rigid drill pipe, the drill string may comprise flexible coiled tubing. A drill string with a rigid drill pipe generally has to be assembled joint by joint, the successive sections being added with increasing depth of the well; a coiled tubing drilling string, on the other hand, comprises flexible tubing instead of the rigid drill pipe, and need not be assembled joint by joint. A coiled tubing drilling string, therefore, can be tripped in and out of the well at a much faster speed than a drill string with a rigid drill pipe. Similarly, hybrid drill strings, which combine the rigidity of the drill pipe but reduce, if not eliminate, the need to assemble the pipe in parts, may also be employed. Coiled tubing drill strings and hybrid coiled tubing drill strings are known in the art.

Once an oil well is drilled, it may be plugged and abandoned as a dry hole. If, however, oil is to be produced from the well, the well must generally undergo a process referred to as "well completion." To complete the well, the hole of the well may be cased. Casing involves aligning the wall of the well with hollow pipes made of steel or other suitable materials. Generally, these pipes are of different diameters, which are joined together to make a continuous hollow tube. The diameters of these pipes are dependent upon the depth or level of the well, and are selected under a program referred to as a "casing program."

FIG. 1 depicts a conventional casing program, and shows how the pipes decrease in diameter with increasing well depth. A conductor pipe 10 has the greatest diameter, and is connected to surface casing 12. The surface casing 12 is in-turn connected to an intermediate casing 14, which is adjoined to a production casing 16. As can be seen, the surface casing 12 has a greater diameter than the intermediate casing 14, and the intermediate casing 14 has a greater diameter than the production casing 16. Casing is integral for the production of oil from a well, as without the casing, the well may collapse and close. Moreover, casing protects the well stream from outside incumbents, such as water or sand, et cetera. The casing is cemented to the walls of the well, which helps to permanently position the casing within the well. Cement slurry, which consists of cement and certain additives, is pumped into the well. The cement slurry displaces the existing mud in the well, and seals the outside of the different casings to the well hole walls.

The well-completion may be of different types. Open-hole completion refers to a well that is drilled to the top of the hydrocarbon reservoir where it is not cased. Open-hole completions are generally used for reservoirs that are well-known and defined. On the other hand, cased-hole completions require the casing to be run into the reservoir. After the cement slurry dries, perforations 18 are created in the sides of the well by a perforation gun. These perforations 18 perforate through the production casing 16 and the cement, and allow the hydrocarbons outside the well hole to enter into the well stream. Tubing 20 may then be used to bring the oil up to the surface. A wellhead and a Christmas tree are generally installed at the surface of the well, and include tubing heads, casing heads, valve controls, et cetera, to provide surface control of the subsurface conditions of the well.

Sometimes, because of a miscalculation, malfunction, unexpected subsurface conditions, et cetera, a blowout occurs. A blowout is the uncontrolled release of crude oil and/or natural gas from an oil well or gas well after pressure control systems have failed. Often, to remedy the situation, a relief well is drilled close to the production well. Drilling a relief well that attempts to penetrate the rather narrow pipe of the blowout well that is buried in sea-bed many thousands of feet below the sea floor is a complex and timely process, which does not have a very high probability of success. The relief well trajectory has to be guided with electromagnetic signals, and the drilling bit for the relief well must be directed until it is running adjacent and parallel to the blowout well in preparation for penetrating the casing of the blowout well. Next, the relief well must inject the blowout well with drilling mud and cement in an attempt to stem the flow of oil and gas under very high pressure. As manifested by recent spills, the development and implementation of plans for such an effort may take many months, and have not always been successful for various reasons, including for example, insufficient density of the drilling mud.

SUMMARY

Systems and methods for plugging and producing oil from oil wells are disclosed herein. According to one embodiment, a system for plugging an oil well after a blowout comprises a hollow drill string having a first portion, a second portion, a proximal section, and a distal section. Each of the first and second portions are between the proximal section and the distal section. The first portion is closer to the distal section than the second portion. A first supporting member is secured to the drill string adjacent the proximal section. A second supporting member is secured to the drill string adjacent the distal section. A stop having a beveled edge is secured to the drill string adjacent the first portion. A connecting device is situated adjacent the second portion and comprises an inner ring having a first top surface, a first side surface, and a first bottom surface. A plurality of first holders extend from the first top surface. The first bottom surface has a recess complimentary to the beveled edge. A diameter of the inner ring is greater than a diameter of the drill string. The connecting device further comprises an outer ring having a second top surface, a second side surface, and a second bottom surface. A plurality of second holders extend from the second bottom surface. A diameter of the outer ring is greater than the diameter of the inner ring. The second side surface surrounds the first side surface. A first fastening ring has a first locking mechanism to selectively allow the first fastening ring to transition from a closed position to an open position. The first fastening ring has a first holding portion including a first groove. The first groove is configured to allow the first fastening ring to wrap around the first supporting member in the closed position. A second fastening ring has a second locking mechanism to selectively allow the second fastening ring to transition from a closed position to an open position. The second fastening ring has a second holding portion including a second groove which is configured to allow the second fastening ring to wrap around the second supporting member in the closed position. A first skirt comprises a first impermeable material to which a plurality of first rods are secured. Each first rod has a front end, a rear end, and a first loop adjacent the rear end. The first loop of each first rod is pivotally connected to one first holder of the inner ring. The front end of each first rod is clamped by the first fastening ring. A second skirt comprises a second impermeable material to which a plurality of second rods are secured. Each second rod has a front end, a rear end, and a second loop adjacent the rear end. The second loop of each second rod is pivotally connected to one second holder of the outer ring. The front end of each second rod is clamped by the second fastening ring.

According to another embodiment, a method for plugging an oil well after a blowout comprises the step of providing an oil well plugging system. The system comprises a hollow drill string having a first portion, a second portion, a proximal section, and a distal section. Each of the first and second portions are between the proximal section and the distal section. The first portion is closer to the distal section than the second portion. A first supporting member is secured to the drill string adjacent the proximal section. A second supporting member is secured to the drill string adjacent the distal section. A stop having a beveled edge is secured to the drill string adjacent the first portion. A connecting device is situated adjacent the second portion and comprises an inner ring having a first top surface, a first side surface, and a first bottom surface. A plurality of first holders extend from the first top surface. The first bottom surface has a recess complimentary to the beveled edge. A diameter of the inner ring is greater than a diameter of the drill string. The connecting device further comprises an outer ring having a second top surface, a second side surface, and a second bottom surface. A plurality of second holders extend from the second bottom surface. A diameter of the outer ring is greater than the diameter of the inner ring. The second side surface surrounds the first side surface. A first fastening ring has a first locking mechanism to selectively allow the first fastening ring to transition from a closed position to an open position. The first fastening ring has a first holding portion including a first groove. The first groove is configured to allow the first fastening ring to wrap around the first supporting member in the closed position. A second fastening ring has a second locking mechanism to selectively allow the second fastening ring to transition from a closed position to an open position. The second fastening ring has a second holding portion including a second groove which is configured to allow the second fastening ring to wrap around the second supporting member in the closed position. A first skirt comprises a first impermeable material to which a plurality of first rods are secured. Each first rod has a front end, a rear end, and a first loop adjacent the rear end. The first loop of each first rod is pivotally connected to one first holder of the inner ring. The front end of each first rod is clamped by the first fastening ring. A second skirt comprises a second impermeable material to which a plurality of second rods are secured. Each second rod has a front end, a rear end, and a second loop adjacent the rear end. The second loop of each second rod is pivotally connected to one second holder of the outer ring. The front end of each second rod is clamped by the second fastening ring. The method further comprises the step of lowering the system into a reservoir such that each of the first fastening ring and the second fastening ring is past a lower most point of the well. The first fastening ring is closer to the lower most point than the second fastening ring. The second fastening ring is opened to allow the second skirt to fill with oil and expand. The expanded second skirt is allowed to funnel oil into the first skirt via a gap between the first side surface and the drill string. The first fastening ring is opened to allow the first skirt to fill with oil and expand. The connecting device is allowed to slide down to the first portion and mate with the stop. The drill string is pulled towards the lower most point to cause the expanded first skirt to plug the well.

According to another embodiment, a system for plugging an oil well after a blowout comprises a hollow drill string. A connecting device having an upper surface, a side surface, and a lower surface having a recess is loosely situated around the drill string. A first skirt has a plurality of first rods that are each pivotally connected to the upper surface. A second skirt has a plurality of second rods that are each pivotally connected to the lower surface. A first fastening ring is configured to selectively allow the first skirt to transition from a closed position to an open position. A second fastening ring is configured to selectively allow the second skirt to transition from a closed position to an open position. A stop having a beveled edge is secured to the drill string. The recess is configured to allow the connecting device to mate with the stop's beveled edge.

According to yet another embodiment, a system for plugging an oil well comprises a hollow drill string. A connecting device having a top surface and a bottom surface is loosely situated around the drill string. A first skirt is coupled to the top surface. A second skirt is coupled to the bottom surface.

BRIEF DESCRIPTION OF THE SEVERAL VIEWS OF THE DRAWINGS

Illustrative embodiments of the present invention are described in detail below with reference to the attached drawing figures and wherein.

DETAILED DESCRIPTION

Embodiments of the present invention provide systems and methods for stopping the flow of oil and gas from a blowout, and for producing oil from an oil well. In this document, references are made to directions such as top, bottom, outer, inner, and the like. These references are exemplary only and are used to describe the disclosed invention in a typical orientation or operation, but are not independently limiting.

Figure 1:
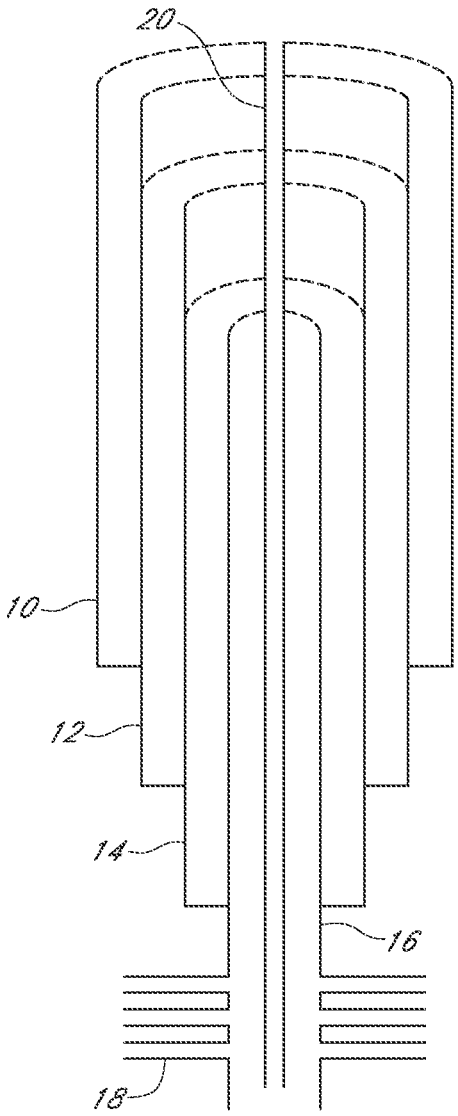
FIG. 1 (PRIOR ART)
FIG. 1 is a perspective view of a PRIOR ART casing program.
Figure 2:
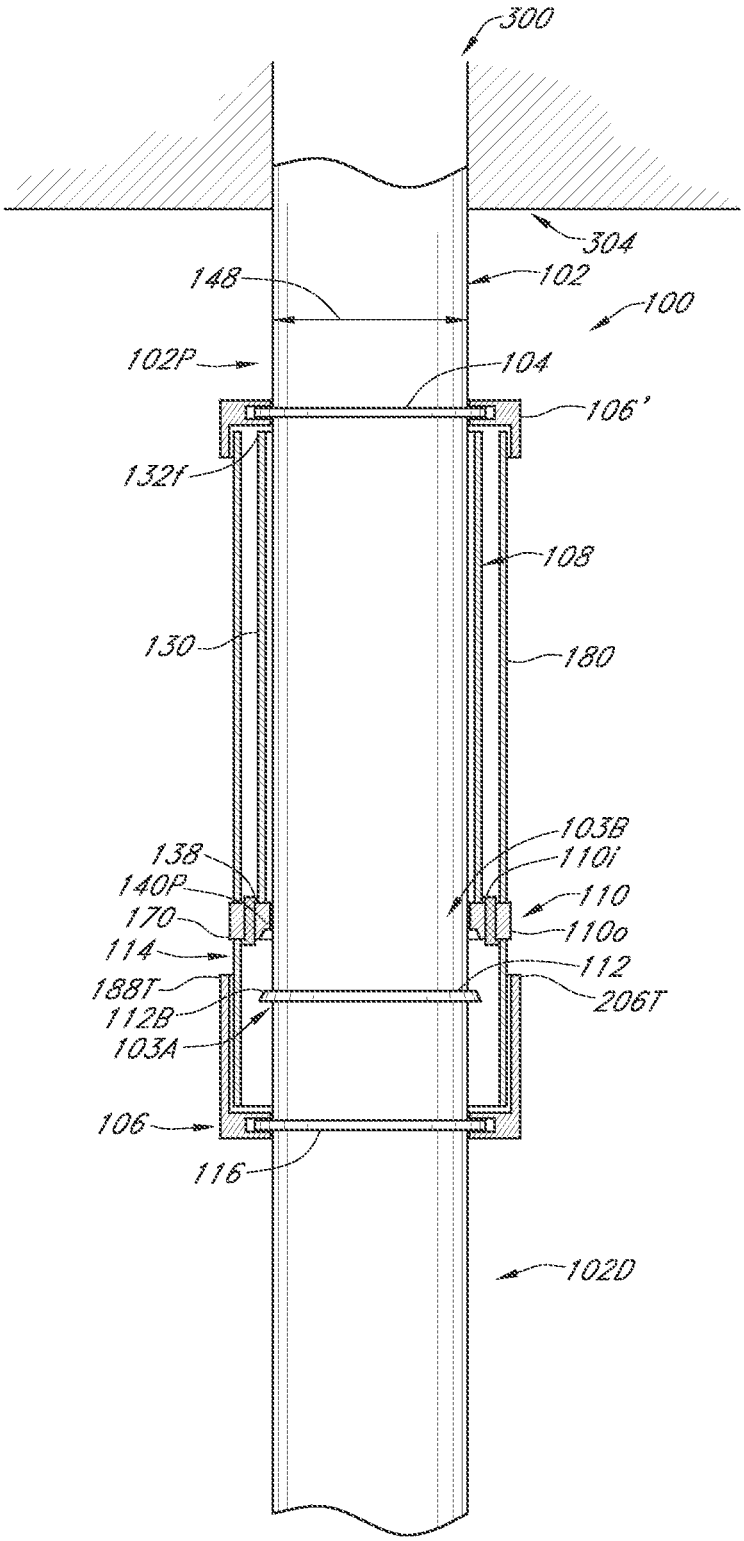
FIG. 2 is a cross-sectional view of an oil well plugging system, according to an embodiment of the current invention.

FIG. 2 shows a system 100 for plugging an oil well in line with the teachings of the current invention. The oil well plugging system 100 may comprise a drill string 102, a first supporting member 104, a first fastening ring 106', a first skirt 108, a connecting device 110 having an inner ring 110*i* and an outer ring 110*o*, a second fastening ring 106, a stop 112, a second skirt 114, and a second supporting member 116.

Figure 3A:
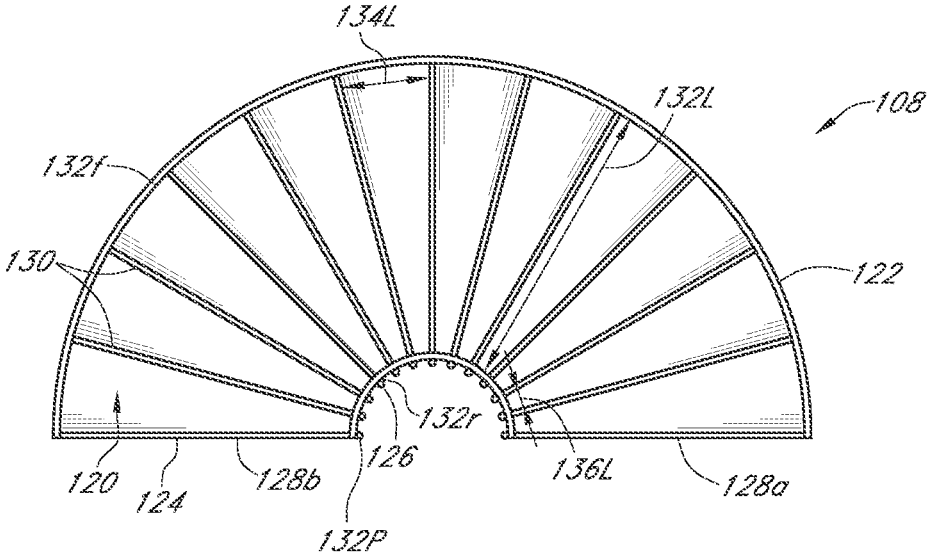
FIGS. 3A and 3B are top views of a first skirt and a second skirt of the oil well plugging system of FIG. 2, respectively.

Attention is now directed to FIG. 3A, which shows the first skirt 108. The first skirt 108 may comprise an impermeable material 120, which may be any desirable material or combination of materials that is generally impervious, durable, and flexible. For example, the impermeable material 120 may comprise synthetic fiber (e.g., para-aramid synthetic fiber such as Keviar®). Or, for example, the impermeable material 120 may comprise rubber (e.g., synthetic rubber such as neoprene). The impermeable material 120 may first be cut in the shape of a semi-circle having an outer curved edge 122 and an inner straight edge 124. A semi-circular indentation 126 may then be cut out of the inner straight edge 124 to divide the straight edge 124 into a first segment 128*a* and a second segment 128*b*.

A plurality of rods or stays 130 may be secured to the impermeable material 120. The rods 130 may be made of high tensile strength metal, such as high alloy steel, titanium, or other suitably rigid materials. The rods 130 may each have a front end 132*f*, and a rear end 132*r*. A loop 132*p* may be secured (e.g., by welding, epoxy, et cetera) to or formed integrally with the rear end 132*r* of each rod 130. The rods 130 may be secured to the impermeable material 120 (such as by stitching, glue, stapling, or other means well known in the art) such that the front end 132*f* of each rod 130 is adjacent the curved edge 122, the rear end 132*r* of each rod 130 is adjacent the semi-circular indentation 126, and at least part of the loop 132*p* of each rod 130 extends beyond the semi-circular indentation 126. The rods 130 may be secured to the impermeable material 120 such that a lateral distance 134L between the front ends 132*f* of two adjacent rods 130 is generally equal to the lateral distance 134L between the front ends 132*f* of two other adjacent rods 130. A lateral distance 136L between the rear ends 132*r* of two adjacent rods 130 may similarly be generally equal to the lateral distance 136L between the rear ends 132*r* of two other adjacent rods 130. The perimeter of the curved edge 122 may be greater than the perimeter of the semi-circular indentation 126, and as such, the lateral distance 134L between the front ends 132*f* of two adjacent rods 130 may be greater than the lateral distance 136L between the rear ends 132*r* of the same rods 130.

Figure 4A:
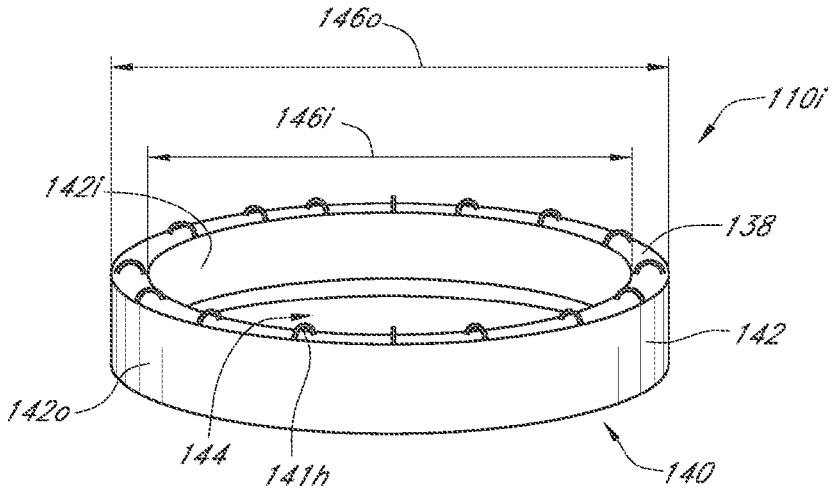
FIGS. 4A and 4B are perspective views of an inner ring and an outer ring of the oil well plugging system of FIG. 2, respectively.

The first skirt 108 may be pivotally connected to the inner ring 110*i*. The inner ring 110*i* may be rigid and as shown in FIG. 4A, and have a top surface 138, a bottom surface 140, and a side 142 having an inner surface 142*i* and an outer surface 142*o*. A cylindrical cavity 144 within the inner ring 110*i* may be defined by the inner side surface 142*i*, and an inner diameter 146*i* of the inner ring 110*i* (i.e., the diameter of the cavity 144) may be less than an outer diameter 146*o* of the inner ring 110*i*. For reasons discussed further below, the inner diameter 146*i* of the inner ring 110*i* may be at least slightly greater than an outer diameter 148 (see FIG. 2) of the drill string 102.

Figure 5:
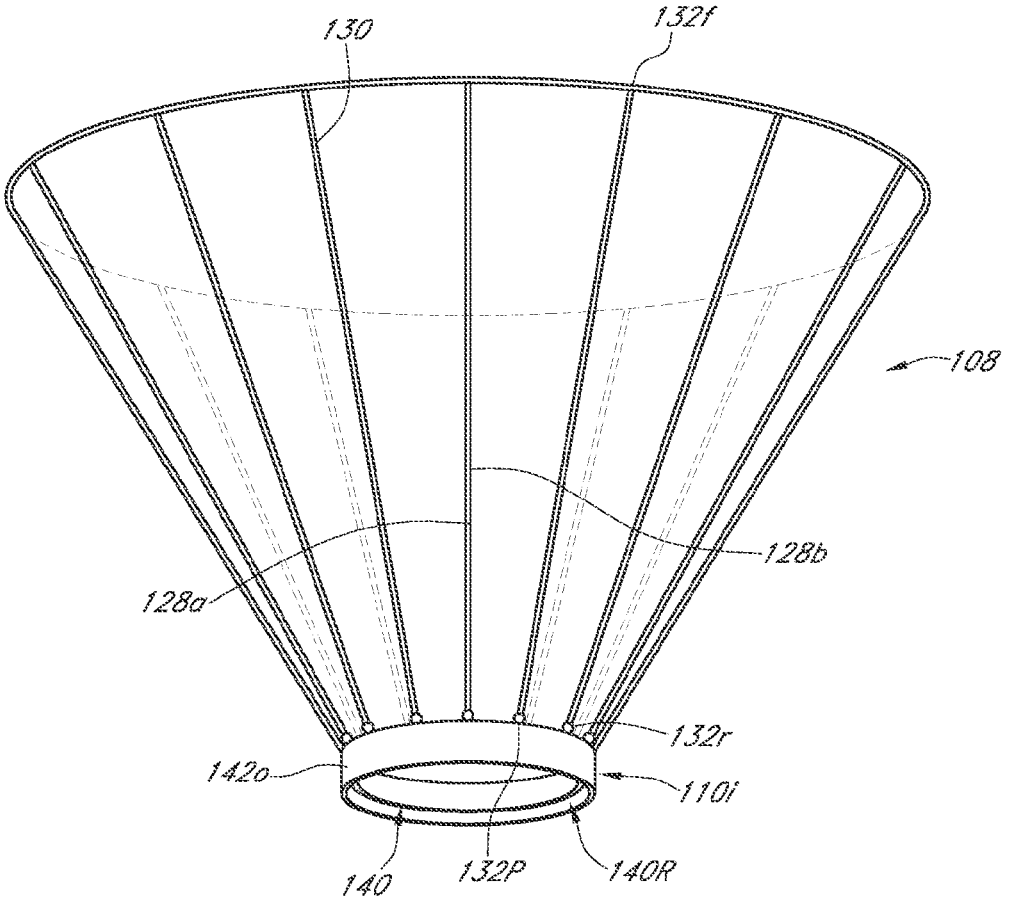
FIG. 5 is a perspective view of the first skirt adhered to the inner ring.

A plurality of holders 141*h* may extend from the top surface 138 of the inner ring 110*i*. The holders 141*h* may be generally semi-circular, and may be configured to allow the first skirt 108 to be pivotally connected to the top surface 138 of the inner ring 110*i*. Specifically, the first and second segments 128*a*, 128*b* of the straight edge 124 of the first skirt 108 may be secured to each other (such as by stitching, glue, stapling, or other means well known in the art), and each loop 132*p* of one of the rods 130 may be passed through one of the holders 141*h* on the top surface 138 of the inner ring 110*i* to give the first skirt 108 a conical, tepee tent like shape (see FIG. 5). Selective movement of the loops 132*p* within the holders 141*h* may allow the first skirt 108 to be opened or closed much like a tent or an umbrella, and an outer area covered by the skirt 108 may be greater when the first skirt 108 is in an open position than when the first skirt 108 is in a closed position. The impermeable material 120 of the first skirt 108, once the first skirt 108 is pivotally coupled to the inner ring 110*i*, may be closer to the outer side surface 142*o* of the inner ring 110*i* than the rods 130. That is, the impermeable material 120 of the first skirt 108 may be on the outside as compared to the rods 130 of the first skirt 108.

Figure 3B:
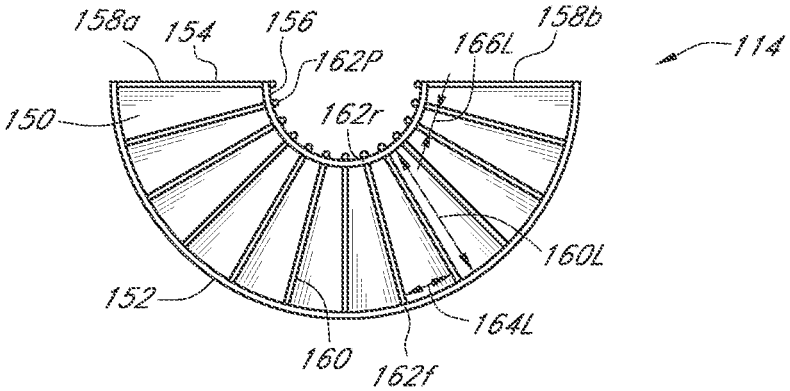

The second skirt 114 (see FIGS. 2, 3B) may similarly comprise an impermeable material 150, which may be any desirable material or combination of materials that is impervious, durable, and flexible. The impermeable material 150 of the second skirt 114 may but need not be the same as the impermeable material 120 of the first skirt 108. As discussed with respect to the first skirt 108, to form the second skirt 114, the impermeable material 150 may first be cut in the shape of a semi-circle having an outer curved edge 152 and an inner straight edge 154. A semi-circular indentation 156 may then be cut out of the inner straight edge 154 to divide the straight edge 154 into a first segment 158*a* and a second segment 158*b*. A plurality of rods or stays 160, each having a front end 162*f*, a rear end 162*r*, and a loop 162*p* adjacent the rear end 162*r* may be secured to the impermeable material 150 (such as by stitching, glue, stapling, or other means well known in the art) such that the front ends 162*f* of the rods 160 are adjacent the outer curved edge 152, the rear ends 162*r* of the rods 160 are adjacent the semi-circular indentation 156, and at least a part of the loop 162*p* of each rod 160 extends beyond the impermeable material 150. A lateral distance 164L between the front ends 162*f* of two adjacent rods 160 may be generally equal to the lateral distance 164L between the front ends 162*f* of two other adjacent rods 160. A lateral distance 166L between the rear ends 162*r* of two adjacent rods 160 may similarly be generally equal to the lateral distance 166L between the rear ends 162*r* of two other adjacent rods 160. Since the perimeter of the semi-circular indentation 156 may be less than the perimeter of the curved edge 152, the lateral distance 164L between the front ends 162*f* of two adjacent rods 160 may be greater than the lateral distance 166L between the rear ends 162*r* of the same rods 160.

Figure 4B:
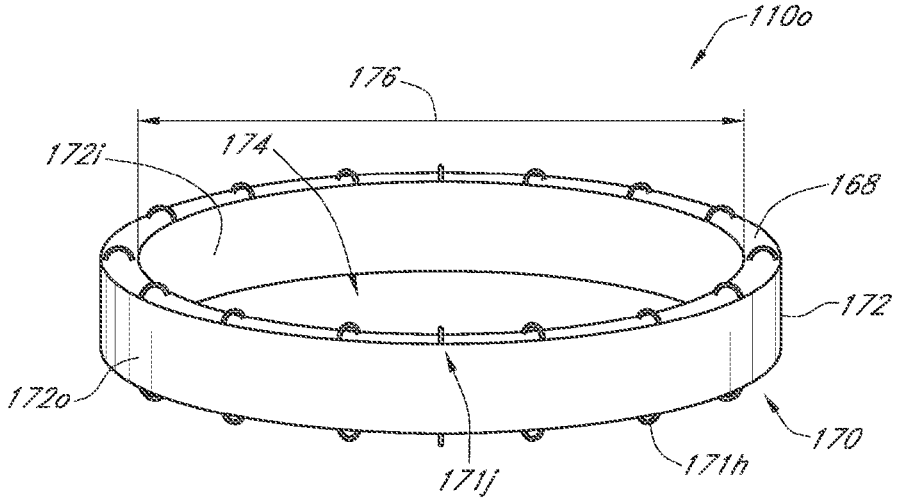

The outer ring 110*o* may be rigid akin to the inner ring 110*i*, and have a top surface 168, a bottom surface 170, and a side 172 having an inner surface 172*i* and an outer surface 172*o*. A cylindrical cavity 174 defined by the inner side surface 172*i* may be formed within the outer ring 110*o*. An inner diameter 176 of the outer ring 110*o* (i.e., the diameter of the cavity 174) may be slightly greater than the outer diameter 146*o* of the inner ring 110*i*. A plurality of generally semi-circular holders 171*h* may extend from the bottom surface 170 of the outer ring 110*o* (see FIG. 4B).

The second skirt 114 may be pivotally connected to the outer ring 110*o*. Specifically, the first and second segments 158*a*, 158*b* of the straight edge 154 of the second skirt 114 may be secured to each other (such as by stitching, glue, stapling, or other means well known in the art), and each loop 162*p* of one rod 160 may be passed through one of the holders 171*h* on the bottom surface 170 of the outer ring 110*o* to give the second skirt 114 a conical, tepee tent like shape. Selective movement of the loops 162*p* of the rods 160 within the holders 171*h* may allow the second skirt 114 to be opened or closed like an umbrella, and an outer area covered by the second skirt 114 may be greater when the skirt 114 is in an open position as compared to a closed position. Unlike the first skirt 108, the impermeable material 150 of the second skirt 114, once the second skirt 114 is coupled to the outer ring 110*o*, may be further away from the outer side surface 172*o* of the outer ring 110*o* than the rods 160. That is, the impermeable material 150 of the second skirt 114 may be on the inside as compared to the rods 150 of the second skirt 114.

Figure 6:
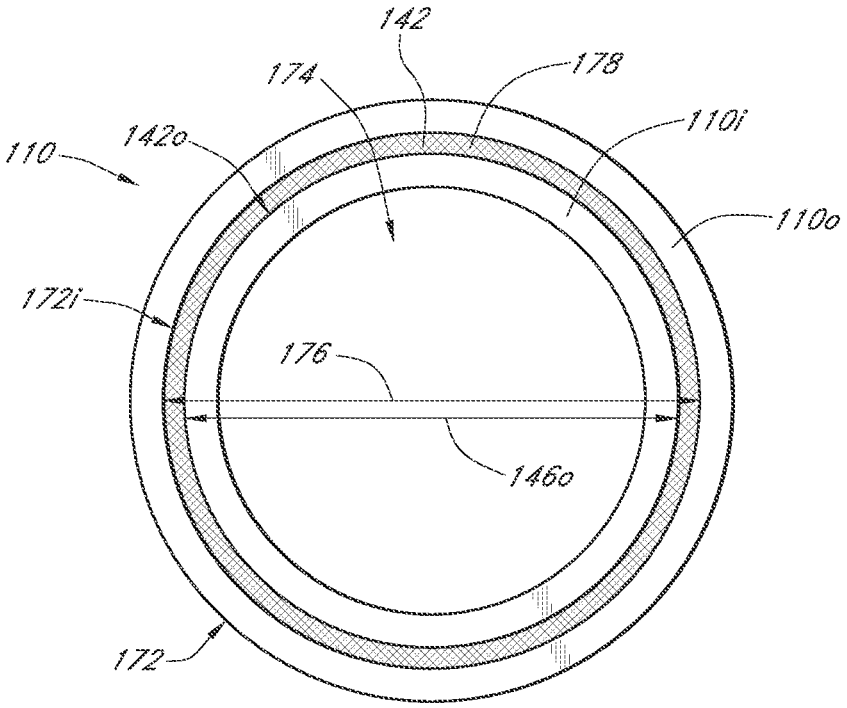
FIG. 6 is a top view of the inner ring and the outer ring forming a connecting device of the oil well plugging system of FIG. 2.

The inner ring 110*i* and the outer ring 110*o* may collectively form the connecting device 110. FIG. 6 shows a top view of the connecting device 110 (without the holders 141*h*, the holders 171*j* discussed below, and the first skirt 108 that is pivotally coupled to the top surface 138 (e.g., at the holders 141*h*) of the inner ring 110*i*). As the inner diameter 176 of the outer ring 110*o* is greater than the outer diameter 146*o* of the inner ring 110*i*, the inner ring 110*i* may be placed within the cavity 174 of the outer ring 110*o* such that the outer side surface 142*o* of the inner ring 110*i* is inwardly adjacent the inner side surface 172*i* of the outer ring 110*o*.

An impermeable material 178 may be used to link the first skirt 108 to the second skirt 114. Specifically, one end of the impermeable material 178 may be secured to the semi-circular indentation 126 of the first skirt 108, and the other end of the impermeable material 178 may be passed between the outer side surface 142*o* of the inner ring 110*i* and the inner side surface 172*i* of the outer ring 110 and be secured to the semi-circular indentation 156 of the second skirt 114 (see FIG. 12). The impermeable material 178 may but need not be the same as the impermeable material 120 of the first skirt 108 or the impermeable material 150 of the second skirt 114. The impermeable material 178 may ensure that oil entering the first skirt 108 and the second skirt 114 does not leak out through the loops 132*p*, 162*p* and the holders 141*h*, 171*h*, respectively.

Attention is now directed to FIGS. 7A-7D, which show the second fastening ring 106. The second fastening ring 106 may comprise a female member 184 and a male member 186. The female and male members 184, 186 may have a same height 187H. The height 187H may be only slightly less than a length 160L of the rods 160 of the second skirt 114. The female member 184 may be generally semi-circular and have a top surface 188T, a bottom surface 188B, an outer side surface 190*o*, an inner side surface 190*i*, a proximal edge 192, and a distal edge 194. A holding portion 196 may extend from the inner side surface 190*i* of the female member 184, and have a recess or groove 196R (see FIG. 7C) to enable the female member 184 to wrap around the second supporting member 116. A gap 198 adjacent the proximal edge 192 of the female member 184 may commence at the top surface 188T and extend through at least part of the side surface 190. A hole 199, which may be downwardly adjacent and be in vertical alignment with the gap 198, may extend through the bottom surface 188B of the female member 184. The gap 198 and the hole 199 may allow for insertion of a locking key 202. A notch or groove (or recess, indentation, et cetera) 204 may also extend through part of the proximal edge 192 and the side surface 190 of the female member 184 to allow the female member 184 to be locked with respect to the male member 186, as discussed below.

The male member 186 may also be generally semi-circular and have a top surface 206T, a bottom surface 206B, an outer side surface 208*o*, an inner side surface 208*i*, a proximal edge 210, and a distal edge 212. A holding portion 214, which may be generally identical to the holding portion 196 in the female member 184, and part of which may become flush with the holding portion 196 in the female member 184 upon closing of the second fastening ring 106, may extend from the inner side surface 208*i* of the male member 186. Much like the groove 196R in the holding portion 196 in the female member 184, the holding portion 214 may have a groove 214R (see FIG. 7C) that allows the male member 186 to wrap around the second supporting member 116. A protruding element 216 (see FIG. 7D) having a top surface 216T, a bottom surface 216B, a side surface 216S, and an edge 216E may extend from the proximal edge 210 of the male member 186. A hole 218 may commence at the top surface 216T of the protruding member 216 and extend through its bottom surface 216B.

The second fastening ring 106 may be configured in an open position 183*o* (see FIG. 7D) or a locked position 183*c* (see FIG. 7B) via a locking mechanism 221. Specifically, a hinge 220 (see FIG. 7C) which may be biased (e.g by springs) towards putting the second fastening ring 106 in an open position 183*o*, may be provided adjacent the distal edge 194 of the female member 184 and the distal edge 212 of the male member 186. To lock the second fastening ring 106, the protruding member 216 of the male member 186 may first be inserted into the notch 204 of the female member 184 such that the opening 218 in the protruding member 216 of the male member 186 is vertically aligned with the gap 198 and the hole 199 in the female member 184. The locking key 202 may then be passed through the gap 198 in the female member 184, the hole 218 in the male member 186, and the hole 199 in the female member 184 to lock the second fastening ring 106 and prevent relative movement of the female member 184 with respect to the male member 186. A head 202H of the locking key 202 may abut against the top surface 188T of the female locking member 184 (and in some embodiments, also the top surface 206T of the male locking member 186) when the second fastening ring 106 is in the locked position 183*c*, ensuring that the key 202 does not fall through the gap 198 and holes 199, 218.

To unlock the second fastening ring 106, the locking key 202 may be pulled in direction A (see FIG. 7B) out of the gap 198 and hole 199 in the female member 184 and the hole 218 in the male member 186. This may be effectuated in one of any number of ways (e.g., electronically, hydraulically, mechanically, et cetera). For example, a line or string 210 (see FIG. 7B) of a durable material may be tied around the head 202H of the key 202, and the line 210 may be pulled in direction A to pull the key 202 out the holes 199, 218. The hinge 220 may then cause the ring 106 to open in the open position 183*o* such that the holding portions 196 and 214 of the female and male members 184, 186 are no longer wrapped around the second supporting member 116. People of skill in the art will appreciate that the locking key 202 may but need not be removed from the gap 198 to unlock the second fastening ring 106, but only pulled out the holes 199, 218 in the female and male members 184, 186, respectively.

Figure 7A:
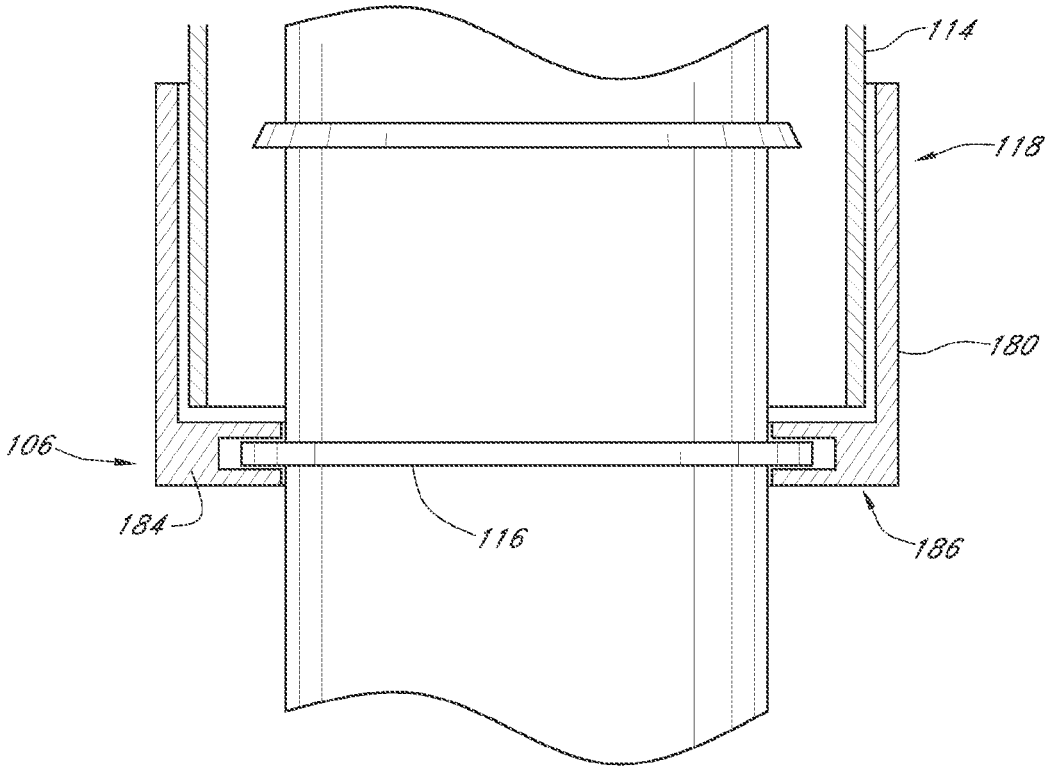
FIGS. 7A-7D show a second fastening ring of the system of FIG. 2.
Figure 7B:
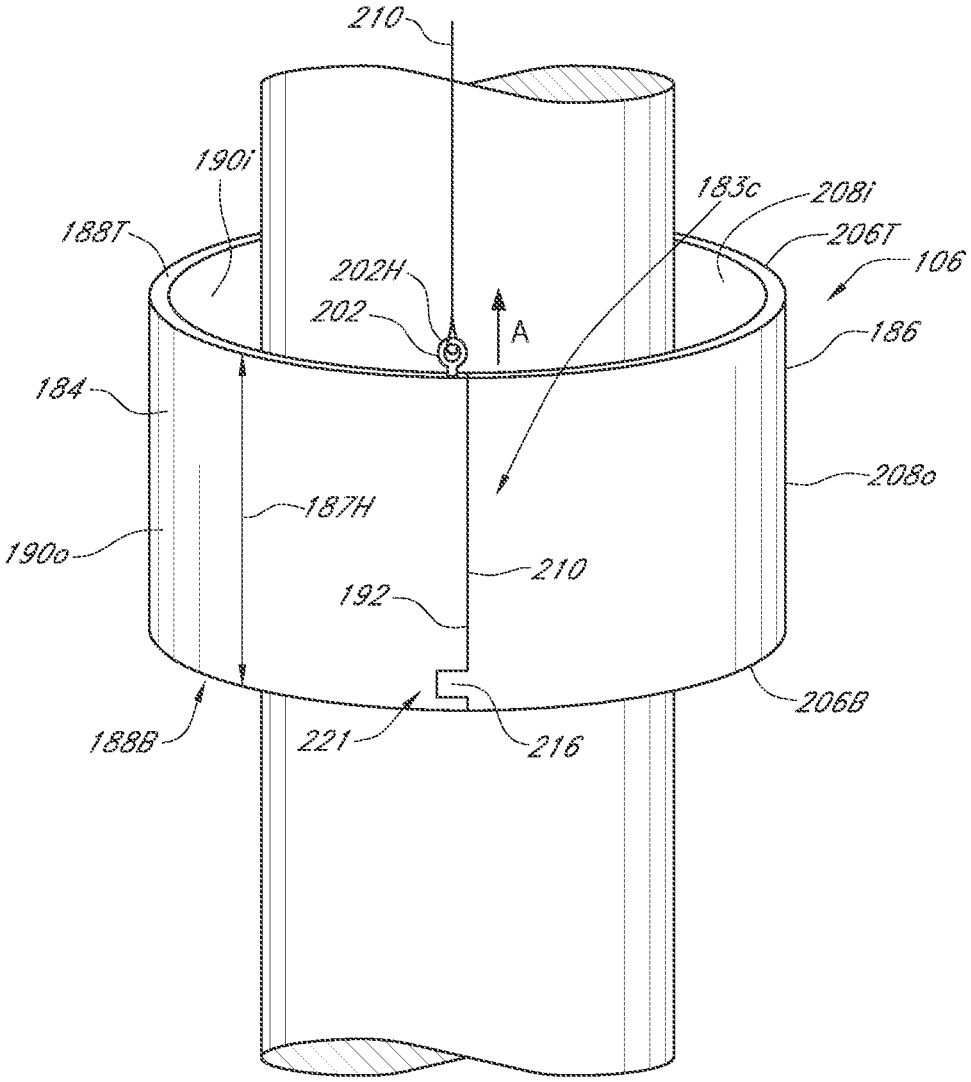
Figure 7C:
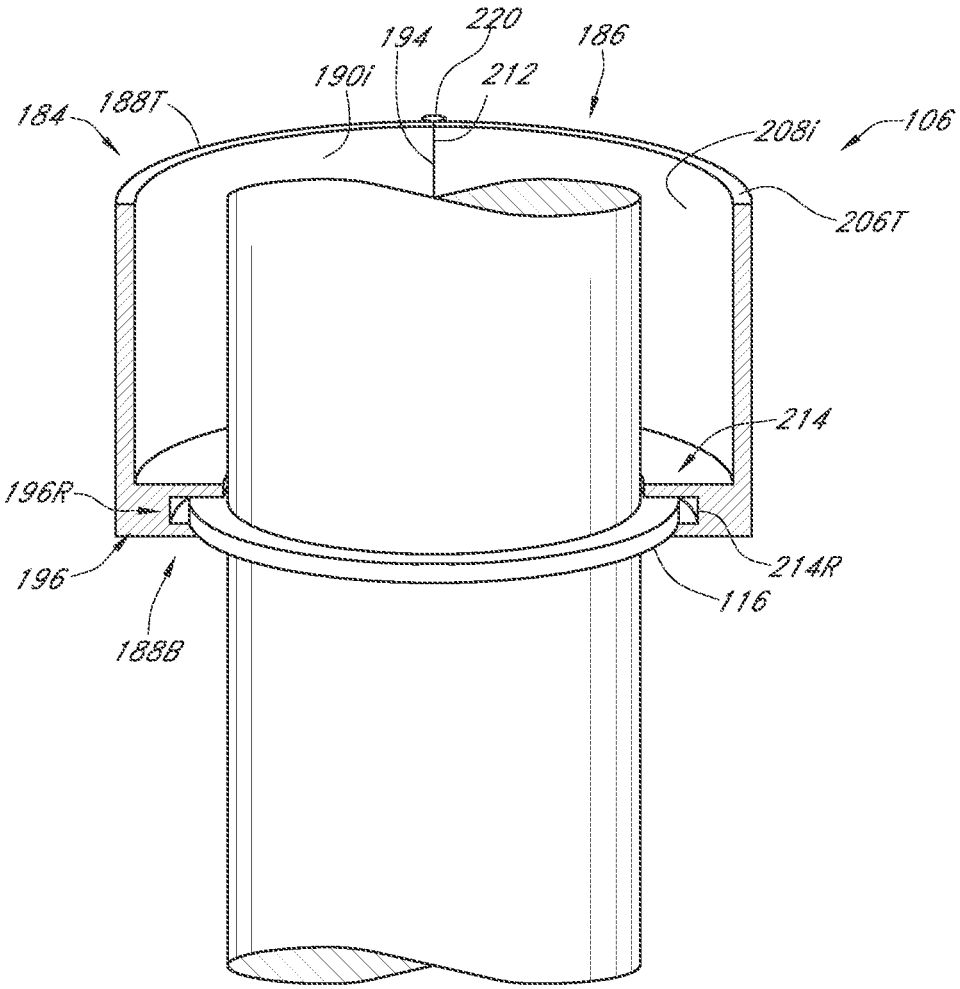
Figure 7D:
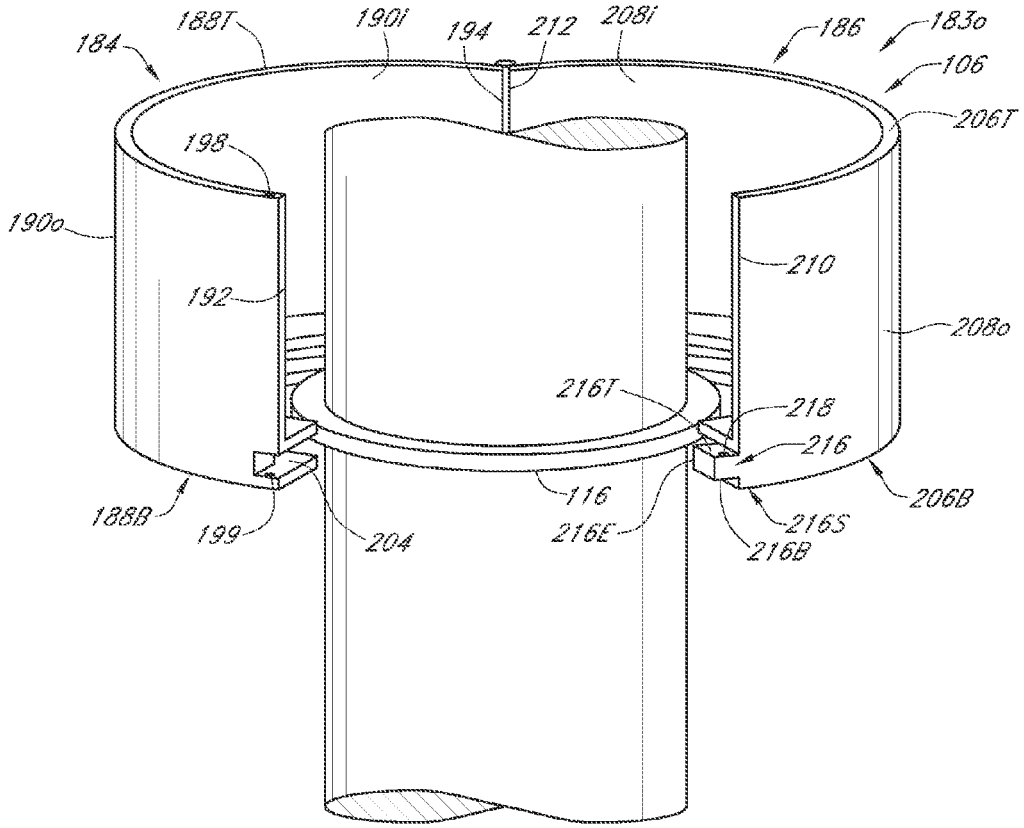
Figure 7E:
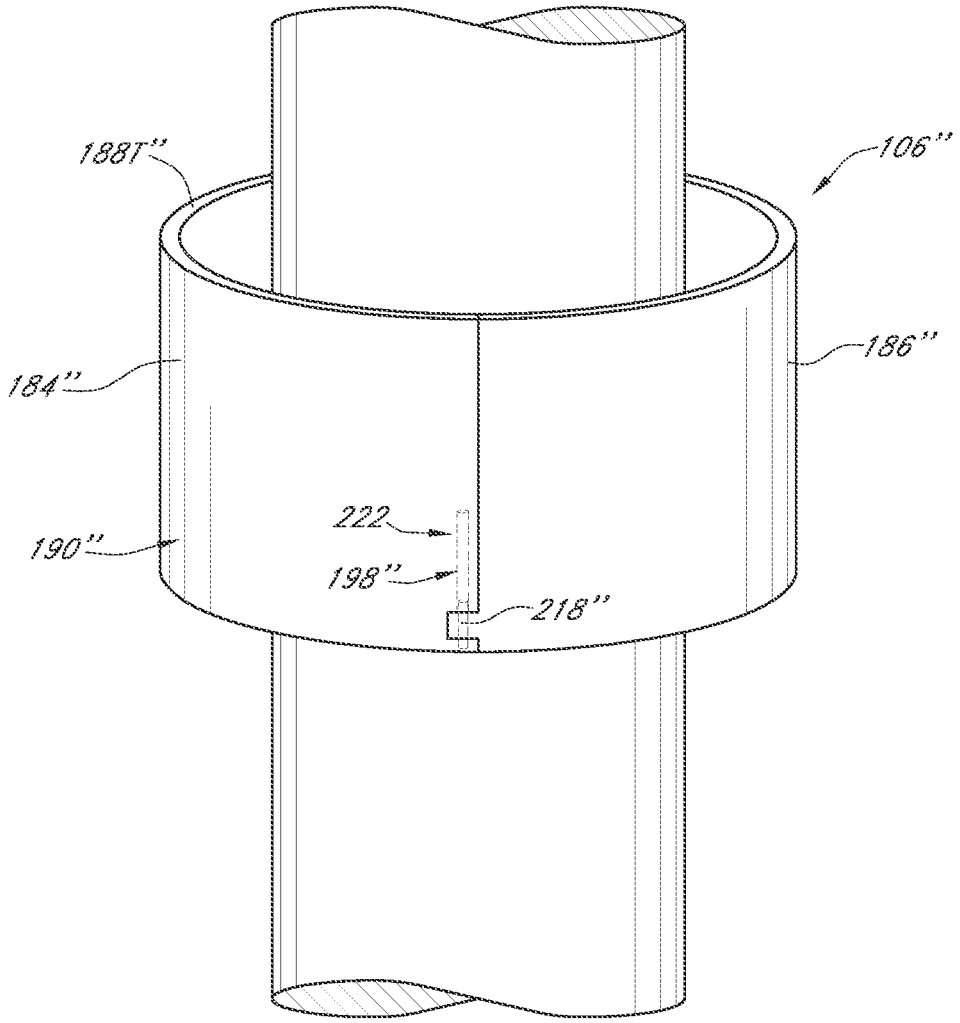
FIG. 7E shows an alternative embodiment of the second fastening ring of FIGS. 7A-7D.
Figure 7F:
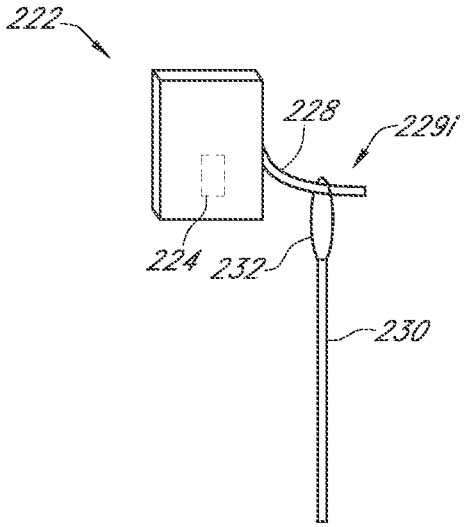
FIGS. 7F-7I show a remote control locking mechanism of the second fastening ring of FIG. 7E and various components associated therewith.
Figure 7G:
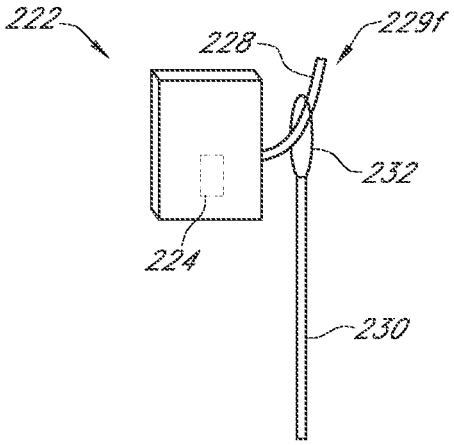

FIGS. 7E to 7G show an alternate embodiment 106" of the second fastening ring 106 that is substantially similar to the second fastening ring 106, except as specifically noted and/or shown, or as would be adherent. Further those skilled in the art will appreciate that the second fastening ring 106" (and thus the second fastening ring 106) may be modified in various ways, such as through incorporating all or part of disclosure above. For uniformity and brevity, corresponding reference numbers of the second fastening ring 106 are used (with a" designation) to indicate corresponding parts of the second fastening ring 106".

Figure 7H:
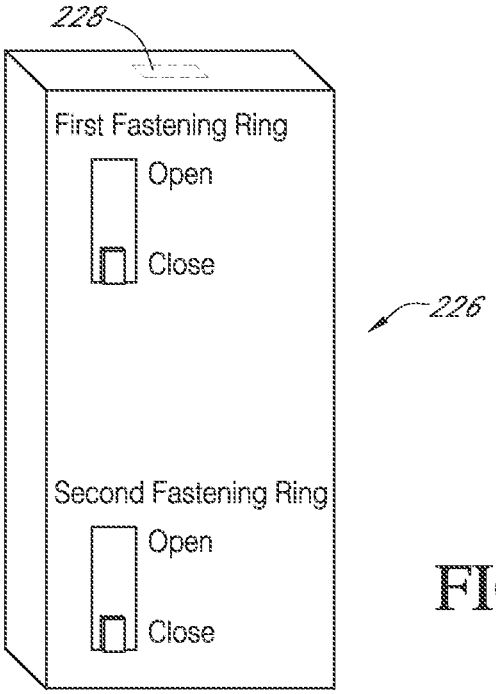
Figure 7I:
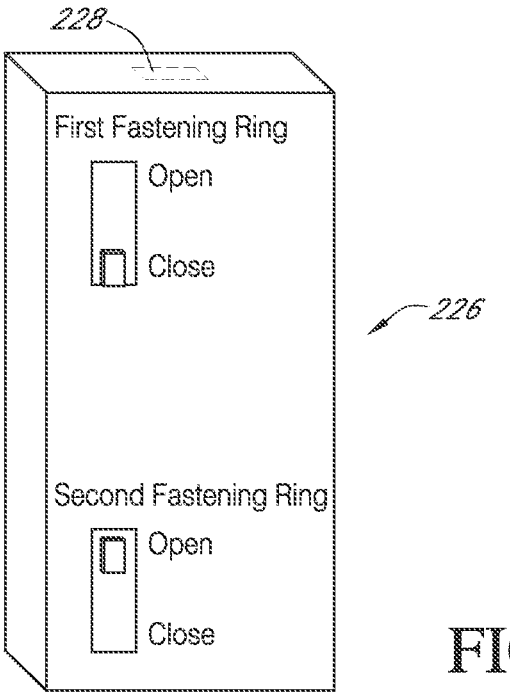

The second fastening ring 106" may have a remote controlled locking mechanism 222 (FIG. 7F). The mechanism 222 may have a sensor 224, which may be any type of sensor utilized in conjunction with remote controllers, such as an infrared sensor, a blue tooth sensor, an RF sensor, et cetera. A remote controller 226 (FIGS. 7H-7I) having a transmitter 228 may be used to unlock the second fastening ring 106 from remote locations (e.g., the ground). For example, the mechanism 222 may comprise a hook 228 that can move from an initial position 229*i* (see FIG. 7F) to a final position 229*f* (see FIG. 7G). A locking key 230 having a head 232 may be operably coupled to the hook 228. When the hook 228 is in its initial position 229*i*, the locking key 230 may extend through the gap 198", and the holes 199", 218" in the female and male locking members 184", 186", as described with respect to the second fastening ring 106. When the ring 106" is to be opened, the remote controller 226 may be used to communicate with the sensor 224 and actuate the hook 228. Specifically, the hook 228, as it moves from the initial position 229*i* to the final position 229*f*, may pull the locking key 230 out of the holes 199", 218". The hinge 220", which as discussed above may be biased by springs to open the second fastening ring 106", may thus cause the holding portions 196" and 214" of the female and male members 184", 186" to move away from the second supporting member 116. People of skill in the art will appreciate that in the second fastening ring 106", the gap 198" may extend only partially through the side surface 190" of the female member 184" and may but need not extend up to the top surface 188T" of the female member 184".

Figure 8:
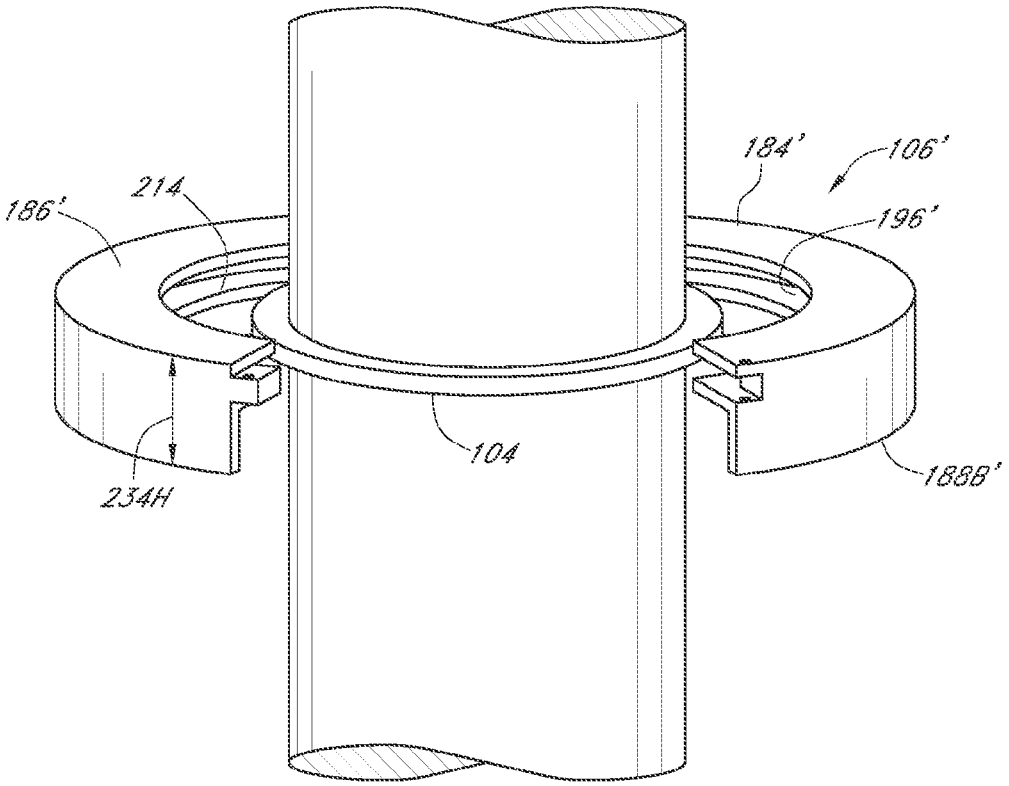
FIG. 8 is a perspective view of a first fastening ring of the system of FIG. 2.

The first fastening ring 106' (FIG. 8) may be substantially similar to the second fastening ring 106 (or the second fastening ring 106"), except as specifically noted and/or shown, or as would be inherent. Further those skilled in the art will appreciate that the first fastening ring 106' may be modified in various ways, such as through incorporating all or part of the disclosure above. For uniformity and brevity, reference numbers of the second fastening ring 106 are used (with a' designation) to indicate corresponding parts of the first fastening ring 106'. The main difference between the first fastening ring 106' and the second fastening ring 106 is that a height 234H of the first fastening ring 106' may, at least in some embodiments, be less than the height 187H of the second fastening ring 106. Embodiments where the height 234H of the first fastening ring 106' is generally equal to or greater than the height 187H of the second fastening ring 106 are also contemplated. In these embodiments, protective stays 180 (discussed below) may, but need not, be eliminated from the oil plugging system 100 as the first fastening ring 106 may function akin to the stays 180 to protect the top skirt 108.

As discussed above, the holding portions 196, 214 of the female and male members 184, 186 of the second fastening ring 106 allow the second fastening ring 106 to wrap around and be supported by the second supporting member 116. The holding portions 196', 214' of the female and male members 184', 186' of the first fastening ring 106' may similarly allow the first fastening ring 106' to wrap around and be supported by the first supporting member 104.

The first supporting member 104 and the second supporting member 116, which may each be ring shaped, may be permanently secured to the drill string 102 (e.g., by welding, glue, fasteners, et cetera). The stop 112 may also be permanently secured to the drill string 102 such that it is below the first supporting member 104 and above the second supporting member 116. The stop 112 may have a beveled surface (or edge) 112B (see FIG. 2). The bottom surface 140 of the inner ring 110*i* of the connecting device 110 may have a groove or recess 140R (see FIG. 5) that is complimentary to the beveled surface 112B of the stop 112. Specifically, if the inner ring 110*i* were to be dropped onto the stop 112, the recess 140R in the bottom surface 140 of the inner ring 110*i* may engage the beveled surface 112B and the inner ring 110*i* may snugly fit onto and mate with the stop 112 (see FIG. 12).

Attention is directed back to FIG. 2 to show the placement of the various components of the oil well plugging system 100 descried above. The drill string 102 may have a distal section 102D and a proximal section 102P. The first supporting member 104 may be permanently secured to the drill string 102 adjacent the proximal section 102P, and the second supporting member 116 may be permanently secured to the drill string 102 adjacent the distal section 102D. The stop 112 may be secured to the drill string 102 at a first portion 103A of the drill string 102 such that the stop 112 is upwardly adjacent the second supporting member 116. The connecting device 110, with the first and second skirts 108, 114 secured thereto as discussed above, may be loosely situated around the drill string 102 above the stop 112 adjacent a second portion 103B of the drill string 102. Specifically, as shown in FIG. 2, the connective device 110 may be situated around the drill string 102 adjacent the second portion 103B such that the bottom surface 170 of the outer ring 110*o* faces the second supporting member 116, and the top surface 138 of the inner ring 110*i* faces the first supporting member 104. As can be seen, in this configuration, the front ends 132*f* of the rods 130 of the first skirt may be adjacent the first supporting member 104, and the front ends 162*f* of the rods 160 of the second skirt 114 may be adjacent the second supporting member 116.

The second fastening ring 106, via the recesses 196R, 214R in its female and male members 184, 186, may be wrapped around the second supporting member 116 such that the top surfaces 188T, 206T of the female and male members 184, 186, face the connecting device 110. The second fastening ring 106 may be locked in the locked position 183*c* around the second supporting member 116 (see FIG. 7B). As can be seen, the inner side surfaces 190*i*, 208*i* of the female and male members 184, 186 of the second fastening ring 106 may abut against the rods 160 of the second skirt 114 and keep the second skirt 114 in a closed position.

The first fastening ring 106', via the recesses 196R', 214R' in its female and male members 184', 186', may similarly be wrapped around the first supporting member 104 and locked in the locked position 183*c*'. As outlined above, the first skirt 108 is pivotally connected to the top surface 138 (and more specifically, the holders 141*h*) of the inner ring 110*i* of the connecting device 110. A plurality of protective stays 180 (see FIG. 2) may also be pivotally connected at regular intervals to the top surface 168 of the outer ring 110*o* of the connecting device 110. Specifically, the top surface 168 of the outer ring 110*o* may have a plurality of semi-circular holders 171*j*, and each protective stay 180 may include a loop 1801 (not specifically shown) that is passed through one semi-circular holder 171*j* to allow the protective stays 180 to pivot akin to the rods 130 of the first skirt 108. The inner side surfaces 190*i*', 208*i*' of the female and male members 184', 186' of the first fastening ring 106' may tightly clamp the front ends 132*f* of the rods 130 of first skirt 108 and the ends of the protective stays 180 against the drill string 102.

Figure 13:
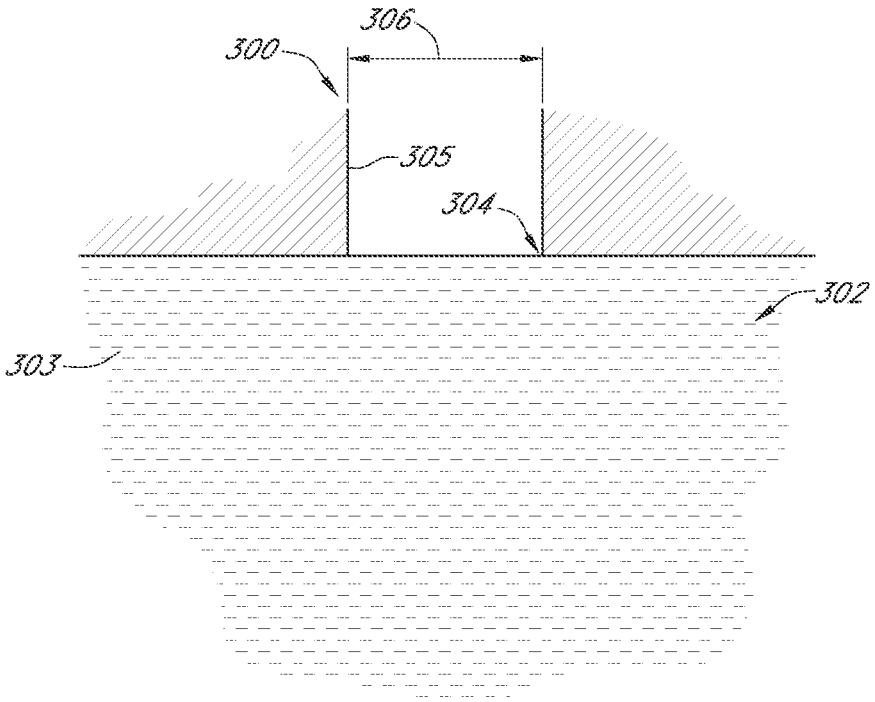
FIG. 13 shows an oil well adjacent an oil reservoir.

Assume now that a blowout occurs in an oil well 300 (FIG. 13) being used to access an oil reservoir 302, and that oil 303 beings to gush out the well 300 uncontrollably. The oil well may have a lower most point 304 adjacent the reservoir 302, sidewalls 305, and a diameter 306. The oil plugging system 100 may be lowered into the well 300 past the lower most point 304 of the well 300 and be used to plug the well 300. Specifically, as shown in FIG. 2, the system 100 may be lowered into the well 300 such that the distal section 102D of the drill string 102 (and the second supporting member 106) is further away from the lower most point 304 of the oil well 300 than the proximal section 102P of the drill string 102 (and the first supporting member 104).

As the system 100 is lowered into the well 300, the outer side surfaces 190*o*, 208*o*, of the female and male members 184, 186 of the second fastening ring 106 may shield and protect the impermeable material 150 of the second skirt 114 from coming into contact with and being damaged by the sidewalls 305 and objects or elements in the well 300. Similarly, the protective stays 180 pivotally coupled (e.g., at holders 171*j*) to the top surface 168 of the outer ring 110*o* of the connecting device 110 may protect the impermeable material 120 of the first skirt 108 from being damaged as the system 100 is lowered into the well 300.

After the system 100 is past the lower most point 304 of the well 300, the second fastening ring 106 which is currently in the locked position 183*c* may be opened (e.g., by pulling out the locking key 202 manually via the line 210 (see FIG. 7B), or for example, by the remote control 226). The second fastening ring 106, upon being placed in the open position 183*o*, may fall off the second supporting member 116 into the reservoir 302. As noted above, the inner diameter 146*i* of the inner ring 110*i* of the connecting device 110 is slightly greater than the outer diameter 148 of the drill string 102. However, the inner side surfaces 190*i*', 208*i*' of the female and male members 184', 186' of the first fastening ring 106', which tightly clamp the first skirt 108 and the protective stays 180 against the drill string 102, may prevent the connecting device 110 from sliding down the drill string 102.

Figure 9:
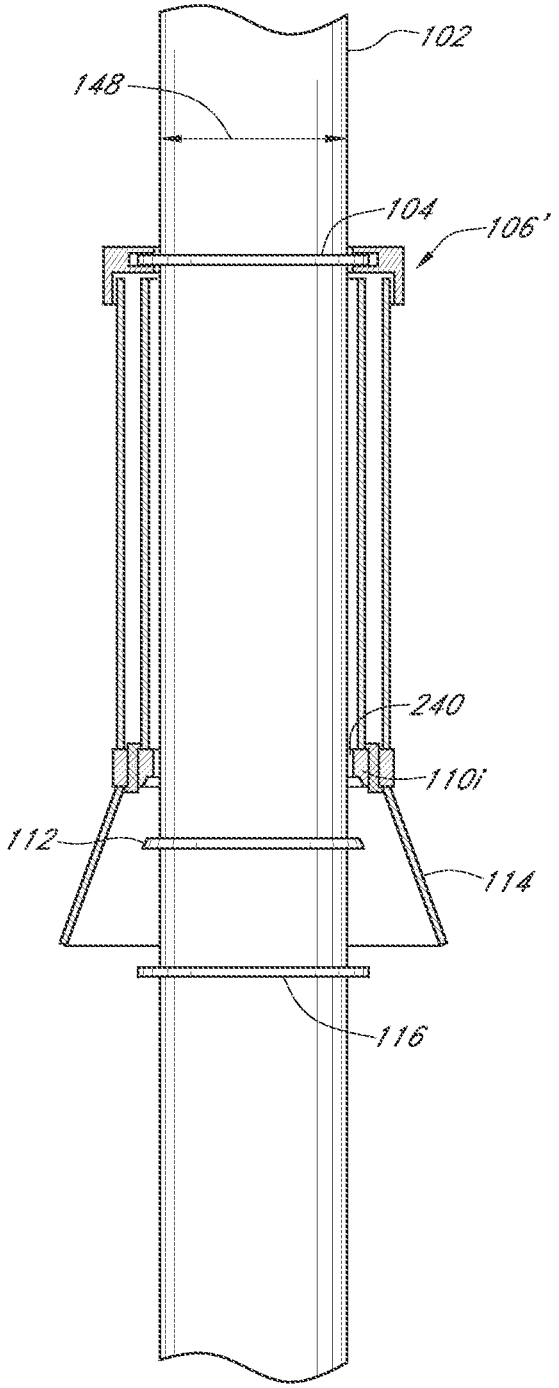
FIG. 9 shows the second skirt of the system of FIG. 2 in an open position after the second fastening ring has been detached from the system.

Once the second fastening ring 106 opens and falls down into the oil reservoir 302, the oil 303 may start gushing into the second skirt 114 and open the second skirt 114 (see FIG. 9). Further, because the inner diameter 146*i* of the inner ring 110*i* of the connecting device 110 (see FIG. 2) is slightly greater than the outer diameter 148 of the drill string, oil 302 may also start gushing into the first skirt 108 via a gap 240 between the inner ring 110*i* and the drill string 102. In effect, the second skirt 114 may act as a funnel and allow an increased volume of the oil 303 to enter the first skirt 108.

Figure 10:
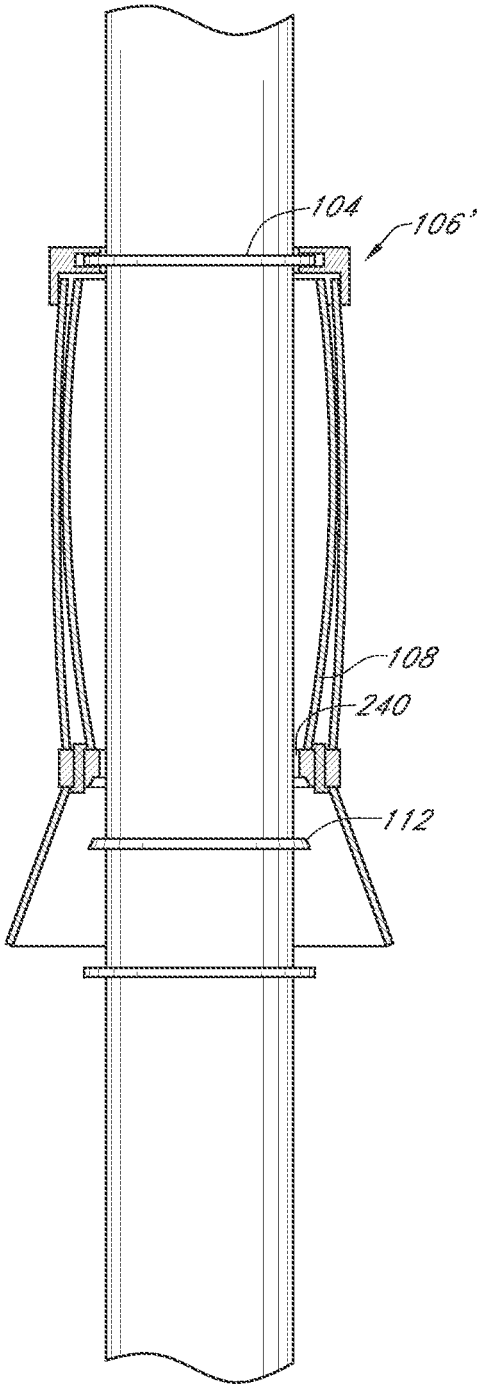
FIG. 10 shows the first skirt of the system of FIG. 2 billowing because of influx of oil.
Figure 11:
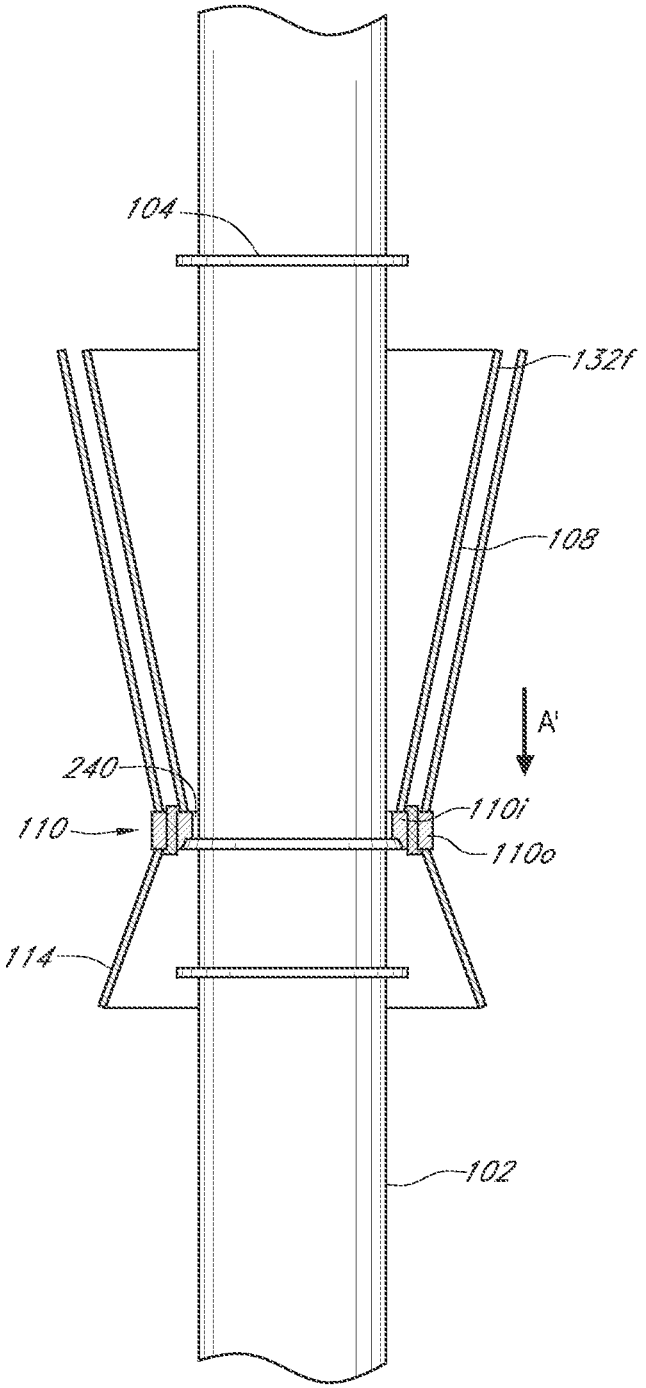
FIG. 11 shows the first skirt in an open position and the sliding of the connecting device down a drill string.

The first skirt 108, still constrained by the first fastening ring 106', may begin to billow because of the influx of the oil 303 (see FIG. 10). The first fastening ring 106' may then be opened (e.g., by pulling out the locking key 202' manually via the line 210', or for example, by the remote control 226), and the first fastening ring 106' may come off the first supporting member 104 and fall into the reservoir 302. Opening of the first fastening ring 106' may create a low pressure area within the first skirt 108 and allow the first skirt 108 to expand. Additional oil 303 may thus flow into the first skirt 108 through the gap 240, causing the first skirt 108 to open fully (see FIG. 11). People of skill in the art will appreciate that the protective stays 180 may pivot as the first skirt 108 opens, and that the protective stays 180 may not prevent or obstruct the opening of the first skirt 108.

Figure 12:
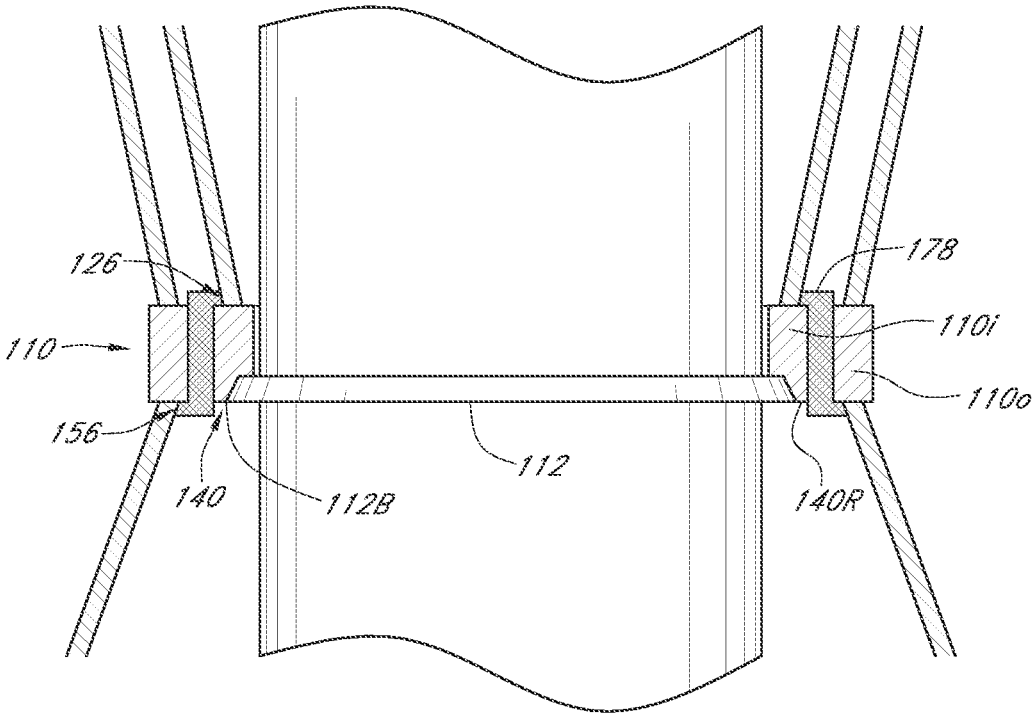
FIG. 12 shows the inner ring fitted onto a stop of the system of FIG. 2.

Opening of the first fastening ring 106' and the weight of the oil 303 within the first skirt 108 may cause the connecting device 110 to slide down the drill string 102 in direction A' (see FIG. 11), and the inner ring 110*i*, by virtue of the recess 140R in its bottom surface 140 and the beveled surface 112B in the stop 112, may tightly fit onto the stop 112 (see FIG. 12). Additional oil 303, thus, may be prevented from entering the top skirt 108. The system 100 may now be pulled upwards until the front ends 132*f* of the rods 130 of the first skirt 108 are adjacent the lower most point 304 of the well 300, and the first skirt 108 covers the well 300. The well 300 may thus be plugged by the system 100. People of skill in the art will appreciate that a length 132L of the rods 130 of the first skirt 108 (and of the impermeable material 120) may be selected such that a diameter of the area covered by the first skirt 108 in its open position is greater than or equal to the diameter 306 of the well 300 at its lower most point 304.

Figure 14:
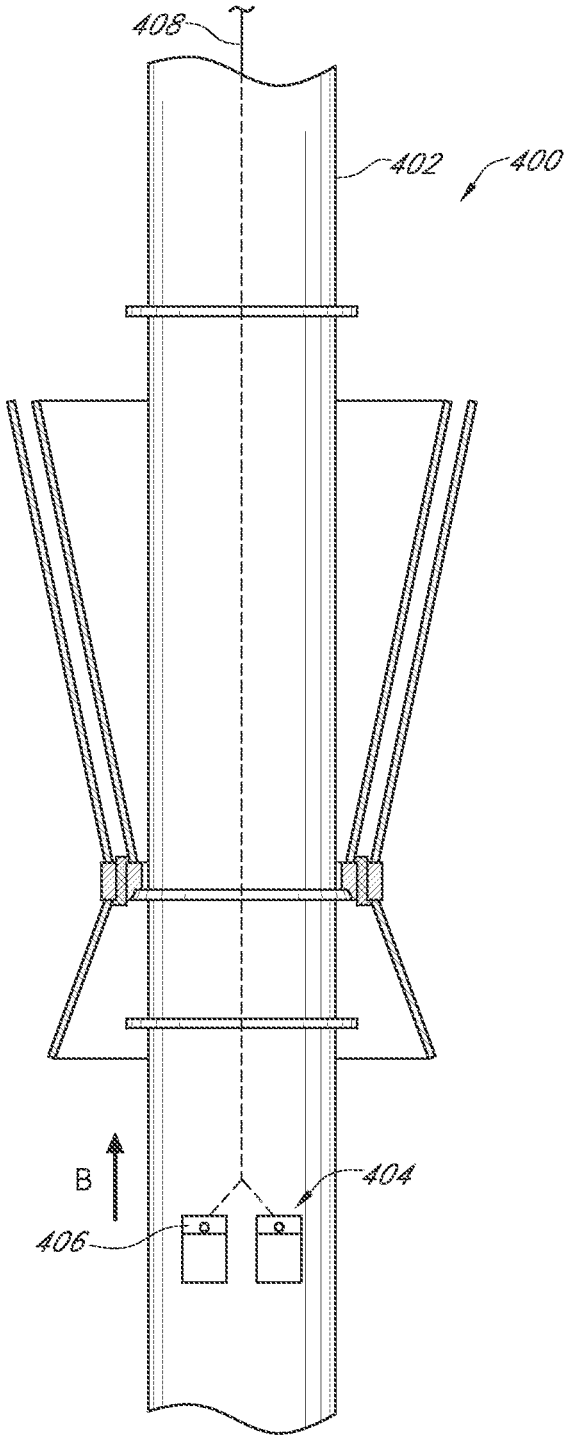
FIG. 14 shows an alternate embodiment of the system of FIG. 2.

Attention is directed to FIG. 14, which shows another embodiment 400 of the oil plugging system 100. The system 400 is substantially similar to the system 100, except that a hollow drill string 402, unlike the drill string 102 of the system 100, includes windows 404. The windows 404, which may initially be closed, may be opened after the well 300 has been plugged by the top skirt 108 to allow the oil 303 to enter the drill string 402. For example, the windows 404 may each comprise a sliding wall 406 that is secured to a line 408, and the line 408 may be pulled in direction B to slide the walls 406 and open the windows 404. Alternatively, the windows 404 may be opened electronically (e.g., via a remote control) or by other conventional means. Once the windows 404 are open, oil 303 may enter the drill string 402 and be guided out the well 300. The system 400 may thus, in addition to plugging the well 300, be used for the production of oil 302.

Attention is now directed to FIGS. 15-19, which show another embodiment 500 of the oil plugging system 100. The oil plugging system 500 may be substantially similar to the system 100, except as specifically noted and/or shown, or as would be inherent. Further those skilled in the art will appreciate that the system 100, and thus the system 500, may be modified in various ways, such as through incorporating all or part of the disclosure above. For uniformity and brevity, where applicable, reference numbers of the system 100 are used to indicate corresponding parts of the system 500.

Much like the system 100, the system 500 comprises the drill string 102 having the proximal section 102P and the distal section 102D, the first supporting member 104, the first fastening ring 106', the connecting device 110 having the inner ring 110*i* and the outer ring 110*o*, the second fastening ring 106, the stop 112, the second skirt 114, and the second supporting member 116. The system 500, however, may not include the first skirt 108 (or the protective stays 180), but instead comprises a balloon or bladder 502. One advantage of using the balloon 502 of system 500 in certain situations as compared to the first skirt 108 of the system 100 is that the balloon 502 may adapt better to uneven surfaces as compared to the first skirt 108.

The balloon 502 may comprise a durable, flexible and impermeable material 503 (FIGS. 16A-16B) such as Kevlar, neoprene, ripstop nylon, Dacron polyester, and/or other suitable materials. To form the balloon 502, the material 503 may first be cut into a first semi-circular member 505 (see FIG. 16A) and a second semi-circular member 505' (see FIG. 16B). The first semi-circular member 505 may have an outer curved edge 507 and an inner straight edge 509. A semi-circular indentation 511*i* may be cut out the inner straight edge 509 to divide the inner straight edge 509 into a first segment 509*a* and a second segment 509*b*. The first segment 509*a* may then be secured to the second segment 509*b* (e.g., by stitching, glue, stapling, et cetera). A neck 513 (FIG. 17A), which may comprise a strip of the impermeable material 503 or of a different impermeable material, may then be secured to the semi-circular indentation 511*i*.

The neck 513 may have a first edge 513*a*, a second edge 513*b*, a first side 513*c*, and a second side 513*d*. The second edge 513*b* may comprise a mouth 513*m*, which may be thicker than the first edge 513*a* and resemble, for example, the relatively thicker mouth of a conventional party balloon. A length of the neck 513 may be generally equal to a length of the semi-circular indentation 511*i*, and the first edge 513*a* of the neck 513 may be secured (e.g., by stitching, glue, et cetera) to the semi-circular indentation 511*i*. The first and second sides 513*c*, 513*d* of the neck 513 may then be secured to each other.

Figure 17A:
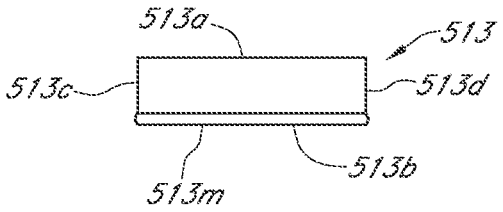
Figure 17B:
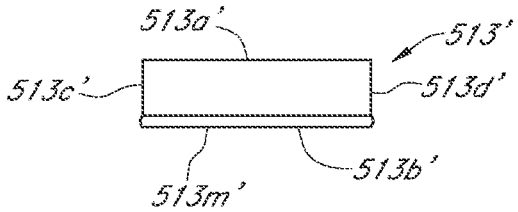
Figure 18:
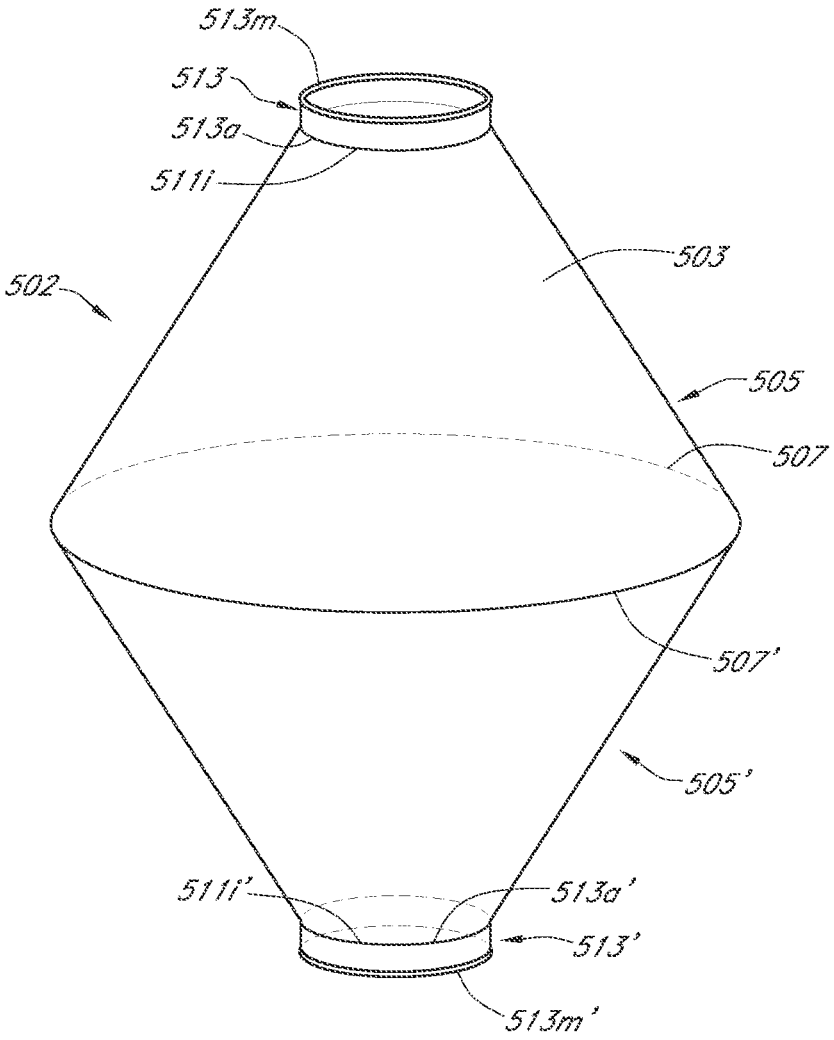

The second semi-circular member 505' may similarly have an outer curved edge 507' and an inner straight edge 509'. A semi-circular indentation 511*i'* may be cut out the inner straight edge 509' to divide the inner straight edge 509' into a first segment 509*a'* and a second segment 509*b'*. The first segment 509*a'* may then be secured to the second segment 509*b'* (e.g., by stitching, glue, stapling, et cetera). A neck 513' (FIG. 17B), which may akin to the neck 513 comprise a strip of the impermeable material 503 or of a different impermeable material, may then be secured to the semi-circular indentation 511*i'*. As can be seen in FIG. 17B, the neck 513' may have a first edge 513*a'*, a second edge 513*b'*, a first side 513*c'*, and a second side 513*d'*. The second edge 513*b'* may comprise a mouth 513*m'*, which may be thicker than the first edge 513*a'* and resemble, for example, the relatively thicker mouth of a conventional balloon. A length of the neck 513' may be generally equal to a length of the semi-circular indentation 511*i'*, and the first edge 513*a'* of the neck 513' may be secured (e.g., by stitching, glue, et cetera) to the semi-circular indentation 511*i'*. The first side 513*c'* of the neck 513' may then be secured to its second side 513*d'*. The outer curved edge 507 of the first semi-circular member 505 may then be secured to the outer curved edge 507' of the second semi-circular member 505' (e.g., by stitching, glue, or other conventional means) to form the stretchable balloon 502, as shown in FIG. 18.

Figure 15:
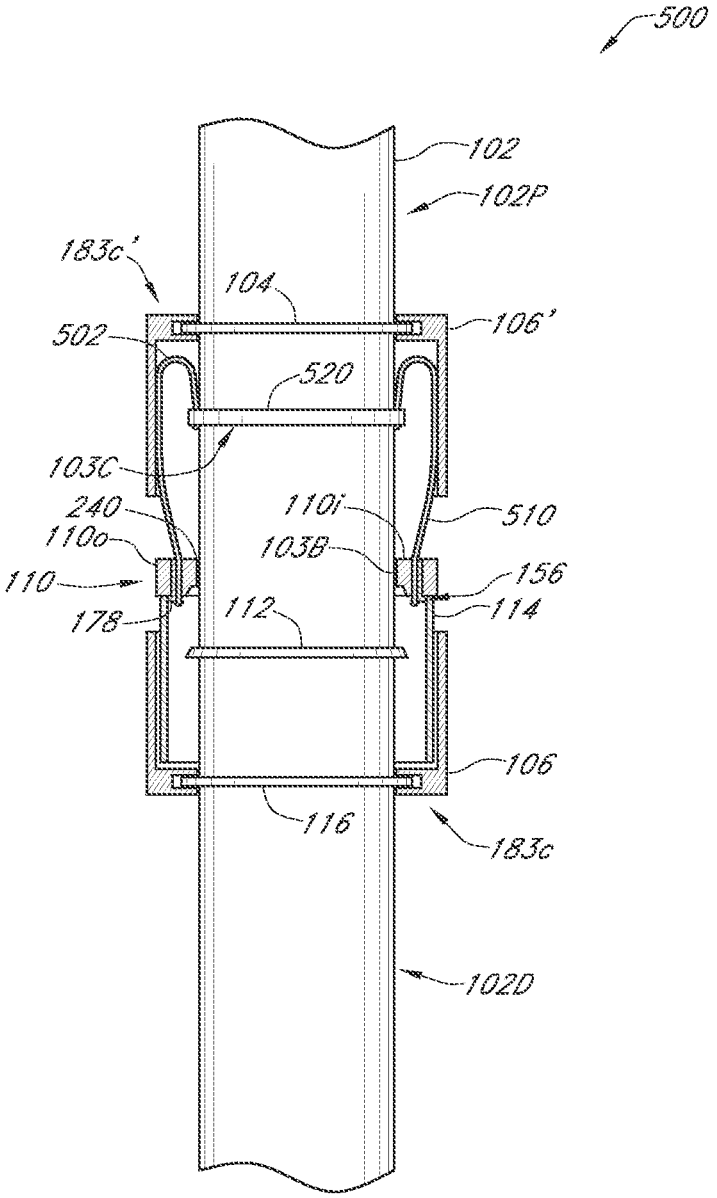
FIG. 15 show yet another alternate embodiment of the system of FIG. 2 having a balloon in an unfilled state.
Figure 16A:
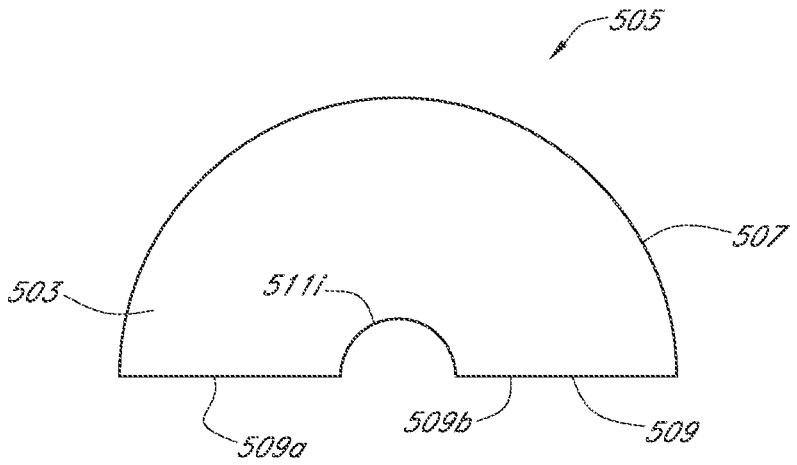
FIGS. 16A, 16B, 17A, 17B and 18 show the balloon of the embodiment of FIG. 15 and its various components.
Figure 16B:
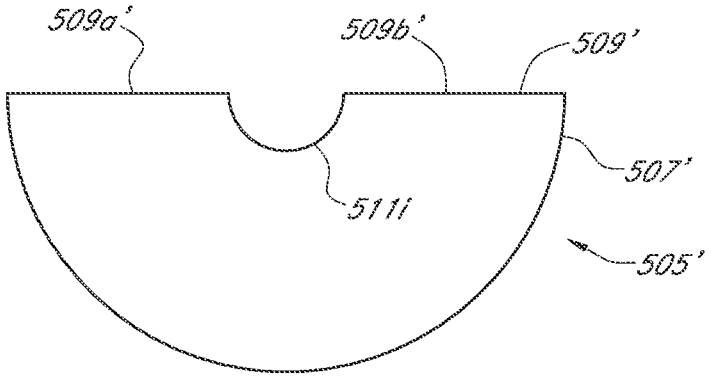
Figure 19:
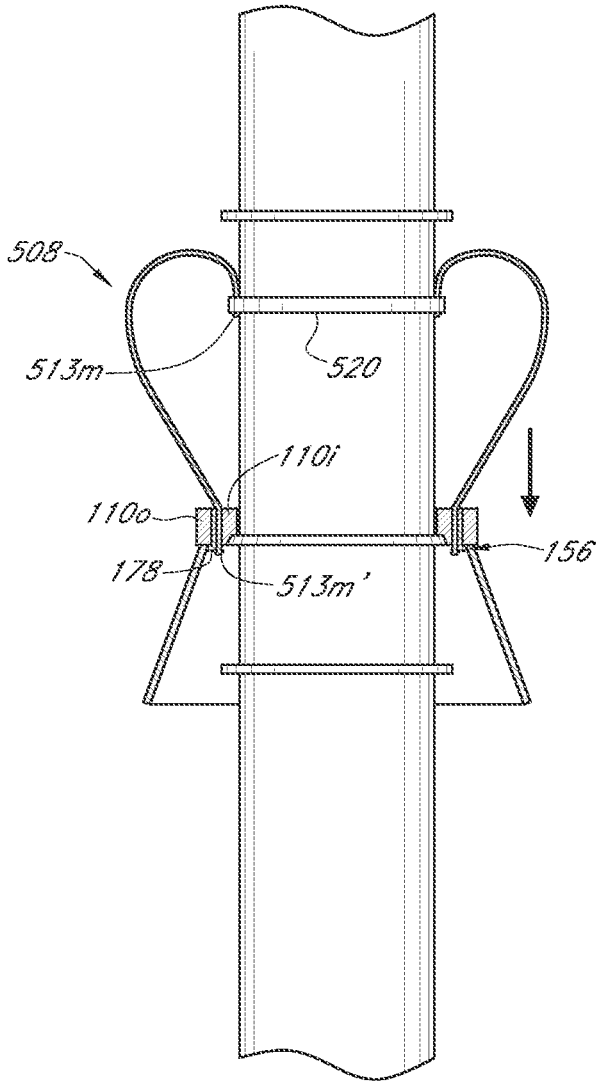
FIG. 19 shows the system of FIG. 15 with the balloon in a filled state.

Attention is now directed back to FIG. 15. A third ring (a holding ring) 520 may be secured to the drill string 102 adjacent a third portion 103C of the string 102. The third portion 103C of the string 102 may be closer to the first fastening ring 106' than the first portion 103A or the second portion 103B. The neck 513 of the balloon 502 may be inverted such that the mouth 513*m* faces the mouth 513*m'*, the first edge 513*a* of the neck 513 is further away from the mouth 513*m'* than the mouth 513*m*, and the mouth 513*m* is inwardly adjacent the material 503. The neck 513 may then be clamped against the drill string 102 by the third ring 520. More specifically, the neck 513 may be clamped by the third ring 520 such that the thicker mouth 513*m* of the balloon 502 is just below the third ring 520 (FIG. 19). The thickness of the mouth 513*m* may help ensure that the neck 513 does not unintentionally slide through the third ring 520 and cause the balloon 502 to separate from the drill string 102 during operation of the system 500.

The neck 513' of the balloon 502 may be clamped between the inner ring 110*i* and the outer ring 110*o*. In embodiment 500, the inner ring 110*i* and the outer ring 110*o* may be secured to each other (e.g., by fasteners, glue, et cetera) to ensure that the balloon 502 does not separate from the connecting device 110 during operation. The mouth 513*m'* of the balloon 502 may be situated just underneath the inner ring 110*i* and outer ring 110*o*, and thickness of the mouth 513*m'* may help ensure that the mouth 513*m'* does not unintentionally slide through the inner and outer rings 110*i*, 110*o* and cause the balloon 502 to separate from the system 500. People of skill in the art will appreciate that a length of the semi-circular indentation 511*i* of the first semi-circular member 505 (and a length of the neck 513 that is secured to the semi-circular indentation 511*i*) may in some embodiments be slightly less than a length of the semi-circular indentation 511*i'* of the second semi-circular member 505' (and a length of the neck 513' that is secured to the semi-circular indentation 511*i'*) because the diameter 148 (FIG. 2) of the drill string 102 may be slightly less than the outer diameter 146*o* (FIG. 4A) of the inner ring 110*i*. In some embodiments, the mouth 513' may be secured to the semi-circular indentation 156 (FIG. 3B) of the second skirt 114 to ensure that no oil escapes through the loops 162*p* and holders 171*h*. In other embodiments, the impermeable material 178 may be secured to the inner surface 1721 of the outer ring 110*o* and the semi-circular indentation 156 to accomplish the same purpose (see FIG. 15).

The balloon 502, when so configured on the drill string 102, may, much like a hot air balloon, be filled with fluid (e.g., oil), and an area covered by the balloon 502 may be greater when the balloon 502 is in a filled state 508 (FIG. 19) than when the balloon 502 is in an unfilled state 510 (FIG. 15). The height 234H of the first fastening ring 106' in the system 500 may be configured such that the balloon 502 generally does not come into contact with and gets inadvertently damaged by the well sidewalls 305 as the system 500 is lowered into the well 300.

Operation of the system 500 may be generally similar to the operation of the system 100. Specifically, the system 500 may first be lowered into the well 300 such that the first fastening ring 106' is past the lower most point 304 (see FIG. 13) of the well 300. As can be seen in FIG. 15, the second fastening ring 106 may initially be in a locked position 183*c* and keep the second skirt 114 in a closed position. The first fastening ring 106' may similarly be in the locked position 183*c'* and keep the balloon 502 in an unfilled state 510.

After the system 500 has been lowered past the lower most point 304 of the well 300, the second fastening ring 106 may be opened (e.g., by pulling out the locking key 202 manually via the line 210 (see FIG. 7B), or for example, by the remote control 226). The second fastening ring 106, upon being placed in the open position 183*o*, may fall off the second supporting member 116 into the reservoir 302. The oil 303 may thus start gushing into the second skirt 114 and open the second skirt 114 (see FIG. 19). Further, because the inner diameter 146*i* of the inner ring 110*i* of the connecting device 110 (see FIG. 2) is slightly greater than the outer diameter 148 of the drill string 102, oil 302 may also start gushing into the balloon 502 via the gap 240 between the inner ring 110*i* and the drill string 102. In effect, the second skirt 114 may act as a funnel and allow an increased volume of the oil 303 to enter the balloon 502.

The balloon 502, still constrained by the first fastening ring 106', may begin to billow because of the influx of the oil 303. The first fastening ring 106' may then be opened (e.g., by pulling out the locking key 202' manually via the line 210', or for example, by the remote control 226), and the first fastening ring 106' may come off the first supporting member 104 and fall into the reservoir 302. The balloon 502, no longer constrained by the first fastening ring 106', may fill with the oil 303.

Opening of the first fastening ring 106' and the weight of the oil 303 within the balloon 502 in its filled state 508 may cause the connecting device 110 to slide down the drill string 102, and the inner ring 110*i*, by virtue of the recess 140R in its bottom surface 140 and the beveled surface 112B in the stop 112, may tightly fit onto the stop 112 as previously described with respect to the system 100. Additional oil 303, thus, may be prevented from entering the balloon 502. The system 500 may now be pulled upwards towards the lower most point 304 of the well 300 such that the balloon 502 covers and plugs the well 300. People of skill in the art will appreciate that the size of resilient material 503 may be configured such that the balloon 502 in its filled state 508 fully plugs the well 300.

Many different arrangements of the various components depicted, as well as components not shown, are possible without departing from the spirit and scope of the present invention. Embodiments of the present invention have been described with the intent to be illustrative rather than restrictive. Alternative embodiments will become apparent to those skilled in the art that do not depart from its scope. A skilled artisan may develop alternative means of implementing the aforementioned improvements without departing from the scope of the present invention.

It will be understood that certain features and subcombinations are of utility and may be employed without reference to other features and subcombinations and are contemplated within the scope of the claims. Not all steps listed in the various figures need be carried out in the specific order described.

The invention claimed is:

1. A system for plugging an oil well after a blowout, the system comprising:

a hollow drill string having a first portion, a second portion, a proximal section, and a distal section; each of the first and second portions being between the proximal section and the distal section; the first portion being closer to the distal section than the second portion;

a first supporting member secured to the drill string adjacent the proximal section;

a second supporting member secured to the drill string adjacent the distal section;

a stop secured to the drill string adjacent the first portion, the stop having a beveled edge;

a connecting device situated adjacent the second portion, the connecting device comprising:

(a) an inner ring having a first top surface, a first side surface, and a first bottom surface; a plurality of first holders extending from the first top surface; the first bottom surface having a recess complimentary to the beveled edge; a diameter of the inner ring being greater than a diameter of the drill string;

(b) an outer ring having a second top surface, a second side surface, and a second bottom surface; a plurality of second holders extending from the second bottom surface; a diameter of the outer ring being greater than the diameter of the inner ring; the second side surface surrounding the first side surface;

a first fastening ring having a first locking mechanism to selectively allow the first fastening ring to transition from a closed position to an open position; the first fastening ring having a first holding portion including a first groove; the first groove configured to allow the first fastening ring to wrap around the first supporting member in the closed position;

a second fastening ring having a second locking mechanism to selectively allow the second fastening ring to transition from a closed position to an open position; the second fastening ring having a second holding portion including a second groove; the second groove configured to allow the second fastening ring to wrap around the second supporting member in the closed position;

a first skirt comprising a first impermeable material having a plurality of first rods secured thereto; each first rod having a front end, a rear end, and a first loop adjacent the rear end; the first loop of each first rod being pivotally connected to one first holder of the inner ring; the front end of each first rod being clamped by the first fastening ring; and a second skirt comprising a second impermeable material having a plurality of second rods secured thereto; each second rod having a front end, a rear end, and a second loop adjacent the rear end; the second loop of each second rod being pivotally connected to one second holder of the outer ring; the front end of each second rod being clamped by the second fastening ring.

2. The system of claim 1, wherein a third impermeable material secured to the first skirt and the second skirt extends between the first side surface and the second side surface.

3. The system of claim 2, wherein a height of the first fastening ring is less than a height of the second fastening ring.

4. The system of claim 3, further comprising:

a plurality of third holders extending from the second top surface; and a plurality of protective stays, each having a third loop;

wherein, each third loop is pivotally connected to one third holder.

5. The system of claim 4, wherein at least one of the first locking mechanism and the second locking mechanism can be actuated using a remote controller.

6. The system of claim 4, wherein:

the first locking mechanism includes a first key; and the second locking mechanism includes a second key.

7. The system of claim 6, wherein a height of each of the first rods is greater than a height of each of the second rods.

8. The system of claim 7, wherein the drill string comprises a plurality of windows.

9. The system of claim 1, wherein at least one of the first impermeable material and the second impermeable material comprises rubber.

10. The system of claim 1, wherein the second fastening ring comprises:

a male member having a protruding element; and a female member having an indentation configured to receive the protruding element.

11. The system of claim 10, wherein:

each of the female member and the male member is operatively coupled to a hinge; and the hinge is biased towards putting the second fastening ring in the open position.

12. A method for plugging an oil well after a blowout, the method comprising steps:

(a) providing an oil well plugging system comprising:

a hollow drill string having a first portion, a second portion, a proximal section, and a distal section; each of the first and second portions being between the proximal section and the distal section; the first portion being closer to the distal section than the second portion;

a first supporting member secured to the drill string adjacent the proximal section;

a second supporting member secured to the drill string adjacent the distal section;

a stop secured to the drill string adjacent the first portion, the stop having a beveled edge;

a connecting device situated adjacent the second portion, the connecting device comprising:

(i) an inner ring having a first top surface, a first side surface, and a first bottom surface; a plurality of first holders extending from the first top surface; the first bottom surface having a recess complimentary to the beveled edge; a diameter of the inner ring being greater than a diameter of the drill string;

(ii) an outer ring having a second top surface, a second side surface, and a second bottom surface; a plurality of second holders extending from the second bottom surface; a diameter of the outer ring being greater than the diameter of the inner ring; the second side surface surrounding the first side surface;

a first fastening ring having a first locking mechanism to selectively allow the first fastening ring to transition from a closed position to an open position; the first fastening ring having a first holding portion including a first groove; the first groove configured to allow the first fastening ring to wrap around the first supporting member in the closed position;

a second fastening ring having a second locking mechanism to selectively allow the second fastening ring to transition from a closed position to an open position; the second fastening ring having a second holding portion including a second groove; the second groove configured to allow the second fastening ring to wrap around the second supporting member in the closed position;

a first skirt comprising a first impermeable material having a plurality of first rods secured thereto; each first rod having a front end, a rear end, and a first loop adjacent the rear end; the first loop of each first rod being pivotally connected to one first holder of the inner ring; the front end of each first rod being clamped by the first fastening ring;

a second skirt comprising a second impermeable material having a plurality of second rods secured thereto; each second rod having a front end, a rear end, and a second loop adjacent the rear end; the second loop of each second rod being pivotally connected to the one second holder of the outer ring; the front end of each second rod being clamped by the second fastening ring;

(b) lowering the system into a reservoir such that each of the first fastening ring and the second fastening ring is past a lower most point of the well; the first fastening ring being closer to the lower most point than the second fastening ring;

(c) opening the second fastening ring to allow the second skirt to fill with oil and expand;

(d) allowing the expanded second skirt to funnel oil into the first skirt via a gap between the first side surface and the drill string;

(e) opening the first fastening ring to allow the first skirt to fill with oil and expand;

(f) allowing the connecting device to slide down to the first portion and mate with the stop; and (g) pulling the drill string towards the lower most point to cause the expanded first skirt to plug the well.

13. The method of claim 12, wherein:

the first locking mechanism includes a key and a hook configured to selectively move from an initial position to a final position; and the hook can be actuated with a remote controller.

14. The method of claim 12, wherein:

the second locking mechanism includes a key and a hook configured to selectively move from an initial position to a final position; and the hook can be actuated with a remote controller.

15. The method of claim 12, wherein the first fastening ring is opened by pulling a line secured to a key of the first locking mechanism.

16. The method of claim 12, wherein a plurality of protective stays are pivotally connected to the second top surface.

17. A system for plugging an oil well after a blowout, the system comprising:

a hollow drill string;

a connecting device loosely situated around the drill string, the connecting device having an upper surface, a side surface, and a lower surface having a recess;

a first skirt having a plurality of first rods, each of the first rods being pivotally connected to the upper surface;

a second skirt having a plurality of second rods, each of the second rods being pivotally connected to the lower surface;

a first fastening ring configured to selectively allow the first skirt to transition from a closed position to an open position;

a second fastening ring configured to selectively allow the second skirt to transition from a closed position to an open position; and a stop secured to the drill string and having a beveled edge;

wherein the recess is configured to allow the connecting device to mate with the stop beveled edge.

18. The system of claim 17, wherein the connecting device comprises an inner ring and an outer ring.

19. The system of claim 18, wherein a plurality of protective stays are pivotally connected to the outer ring.

20. The system of claim 19, wherein a height of the first skirt is greater than a height of the second skirt.

21. A system for plugging an oil well, the system comprising:

a hollow drill string;

a connecting device having a top surface and a bottom surface; the connecting device being situated around the drill string;

first skirt coupled to the top surface; and a second skirt coupled to the bottom surface and facing away from the first skirt; the second skirt configured to funnel oil into the first skirt when the second skirt is placed from a closed position to an open position;

wherein the funneling of the oil from the second skirt into the first skirt causes the connecting device to slide along the drill string and mate with a stop.

* * * * *